US011078607B2

(12) United States Patent
Almog

(10) Patent No.: US 11,078,607 B2
(45) Date of Patent: Aug. 3, 2021

(54) CLOTHING ARTICLES HAVING ENCAPSULATION ZONES, AND SYSTEM AND METHOD OF PRODUCING SUCH CLOTHING ARTICLES

(71) Applicant: Delta Galil Industries Ltd., Caesarea (IL)

(72) Inventor: Eli Almog, Zurit (IL)

(73) Assignee: DELTA GALIL INDUSTRIES LTD., Caesarea (IL)

( * ) Notice: Subject to any disclaimer, the term of this patent is extended or adjusted under 35 U.S.C. 154(b) by 147 days.

(21) Appl. No.: 16/485,168

(22) PCT Filed: Mar. 4, 2018

(86) PCT No.: PCT/IL2018/050240

§ 371 (c)(1),
(2) Date: Aug. 12, 2019

(87) PCT Pub. No.: WO2018/173037

PCT Pub. Date: Sep. 27, 2018

(65) Prior Publication Data

US 2020/0040488 A1 Feb. 6, 2020

Related U.S. Application Data

(60) Provisional application No. 62/475,235, filed on Mar. 23, 2017.

(51) Int. Cl.
*A41B 17/00* (2006.01)
*D02G 3/32* (2006.01)
(Continued)

(52) U.S. Cl.
CPC ..... *D02G 3/32* (2013.01); *A41B 9/00* (2013.01); *A41C 3/12* (2013.01); *A41C 3/0057* (2013.01)

(58) Field of Classification Search
CPC ..... D02G 3/32; A41C 3/12; A41C 3/0057; A41B 9/00
See application file for complete search history.

(56) References Cited

U.S. PATENT DOCUMENTS 2,864,372 A * 12/1958 Buckley ..... A41C 3/10 450/57
3,108,598 A * 10/1963 Sachs ..... A41C 3/00 450/92

(Continued)

FOREIGN PATENT DOCUMENTS

JP 2000303209 A 10/2000

OTHER PUBLICATIONS

International Search Report (ISR) in PCT/IL2018/050240, dated Jun. 6, 2018.

(Continued)

*Primary Examiner* — Robert H Muromoto, Jr.
(74) *Attorney, Agent, or Firm* — Eitan Mehulal Sadot

(57) ABSTRACT

Clothing articles having one or more pre-defined encapsulation zones, as well as systems and methods of producing such clothing articles. A clothing article is made of a fabric intended to cover a region of a human body of a wearer. The fabric includes at least one encapsulation zone which is surrounded by a surrounding region. The encapsulation zone includes at least a first encapsulation region, which is surrounded by a second encapsulation region, which is surrounded by a third encapsulation region. The first encapsulation region has a first level of elasticity; the second encapsulation region has a second level of elasticity that is smaller than the first level of elasticity of the first encapsulation region; the third encapsulation region has a third level of elasticity that is smaller than the second level of elasticity of the second encapsulation region.

19 Claims, 10 Drawing Sheets

(51) Int. Cl.

| | |
|---|---|
| ***A41C 3/12*** | (2006.01) |
| ***A41B 9/00*** | (2006.01) |
| *A41C 3/00* | (2006.01) |

(56) References Cited

U.S. PATENT DOCUMENTS 3,246,648 A * 4/1966 Simon ..... A41C 1/06 450/19
3,824,812 A * 7/1974 Matthews ..... D04B 1/243 66/177
5,465,594 A * 11/1995 Imboden ..... D04B 1/243 66/177
5,537,690 A * 7/1996 Johnson ..... A41C 1/08 2/44
5,605,060 A * 2/1997 Osborne ..... A41C 3/0014 2/69
5,823,851 A * 10/1998 Dicker ..... A41C 3/02 450/2
6,023,789 A * 2/2000 Wilson ..... A41D 1/089 2/228
6,086,450 A * 7/2000 Mankovitz ..... A41C 3/00 450/1
6,272,888 B1 * 8/2001 Fujita ..... A41B 13/005 66/172 E
6,899,591 B2 * 5/2005 Mitchell ..... A41C 5/00 450/65
7,191,470 B2 * 3/2007 Benini ..... A41D 13/0002 2/69
7,442,110 B2 * 10/2008 Gaudet ..... A41C 3/0057 450/39
7,546,751 B2 * 6/2009 Lutz ..... D04B 1/18 66/177
8,225,423 B2 * 7/2012 Benini ..... A41D 13/0002 2/69
8,226,452 B2 * 7/2012 Hendrickson ..... A41C 3/08 450/30
D684,748 S * 6/2013 Carney ..... D2/712
8,469,769 B2 * 6/2013 Hendrickson ..... A41F 15/002 450/30
D685,156 S * 7/2013 Carney ..... D2/712
8,574,027 B2 * 11/2013 Kipnes ..... A41D 1/22 450/31
8,647,168 B2 * 2/2014 Anvaripour ..... A41C 1/003 450/19
9,198,467 B2 * 12/2015 Gordon ..... A41C 1/06
9,301,550 B2 * 4/2016 Sabin ..... A41B 9/005
9,320,306 B2 * 4/2016 Freddi ..... A41D 1/06
9,351,523 B2 * 5/2016 Kitagawa ..... A41C 1/003
9,456,641 B1 * 10/2016 Mignone ..... A63B 21/0552
9,644,293 B2 * 5/2017 Yuasa ..... D04B 21/207
9,833,023 B2 * 12/2017 Sabin ..... A41B 9/001
9,963,821 B2 * 5/2018 Barak ..... D06M 15/643
10,051,896 B2 * 8/2018 Miller ..... A41C 3/0057
10,051,897 B2 * 8/2018 Freddi ..... A41D 1/08
10,058,131 B2 * 8/2018 Solano ..... A41B 11/14
10,080,389 B2 * 9/2018 Melarti ..... A41C 1/12
10,278,431 B2 * 5/2019 McClean ..... A41B 9/06
10,278,432 B2 * 5/2019 Melarti ..... A41C 1/08
10,314,344 B2 * 6/2019 Wittstadt ..... A41C 3/0035
10,368,587 B2 * 8/2019 Oliver ..... A41B 9/004
10,368,590 B2 * 8/2019 Diaz ..... A41C 3/0014
10,405,672 B2 * 9/2019 Chiesa ..... A45C 13/103
10,426,649 B2 * 10/2019 Lyu ..... A41B 9/08
10,477,901 B2 * 11/2019 Melarti ..... A41F 17/00
10,863,781 B2 * 12/2020 Wright ..... A41D 31/18
10,905,175 B1 * 2/2021 DiLorenzo ..... A41D 7/00
2002/0022433 A1 * 2/2002 Yeung ..... A41C 3/0057 450/70
2003/0019014 A1 * 1/2003 Duran ..... A41B 11/003 2/239
2004/0006811 A1 * 1/2004 McKenzie ..... A41B 11/14 2/240
2005/0255789 A1 * 11/2005 Gaudet ..... A41C 3/144 450/41
2006/0148349 A1 * 7/2006 Naor ..... D06M 23/08 442/79
2007/0118954 A1 * 5/2007 Lee ..... A41C 1/003 2/69
2007/0186328 A1 * 8/2007 Bulian ..... A41D 1/084 2/69
2009/0172858 A1 * 7/2009 Oya ..... D04B 21/207 2/69
2012/0174282 A1 * 7/2012 Newton ..... A41D 13/0015 2/69
2018/0352874 A1 * 12/2018 Cahan ..... B32B 1/00
2019/0387813 A1 * 12/2019 Almog ..... A41C 5/00
2020/0214367 A1 * 7/2020 Kobayashi ..... A41C 3/14

OTHER PUBLICATIONS

Written Opinion of the International Searching Authority in PCT/IL2018/050240, dated Jun. 6, 2018.

* cited by examiner

CLOTHING ARTICLES HAVING ENCAPSULATION ZONES, AND SYSTEM AND METHOD OF PRODUCING SUCH CLOTHING ARTICLES

CROSS-REFERENCE TO RELATED APPLICATIONS

This application is a National Stage of PCT international application number PCT/IL2018/050240, having an international filing date of Mar. 4, 2018, published as international publication number WO 2018/173037 A1, which is hereby incorporated by reference in its entirety; which claims priority and benefit from United States provisional patent application number U.S. 62/475,235, filed on Mar. 23, 2017, which is hereby incorporated by reference in its entirety.

FIELD OF THE INVENTION

The present invention is related to the field of clothing.

BACKGROUND

Clothing articles and clothes are typically formed of textile material and are worn on the body. Clothes are worn for various purposes, for example, to keep the human body warm in a cold weather, to protect the human body from rough surfaces or insects or plants, to provide a hygienic barrier between the human body and the environment, to protect the human body from ultraviolet radiation, to cover genitals, for social reasons or as fashion, or the like.

SUMMARY

Some embodiments of the present invention may comprise clothing articles having one or more pre-defined encapsulation zone(s), as well as systems and methods of producing such clothing articles.

The present invention may provide other and/or additional advantages and/or benefits.

DETAILED DESCRIPTION OF SOME DEMONSTRATIVE EMBODIMENTS OF THE INVENTION

Figure 1A:
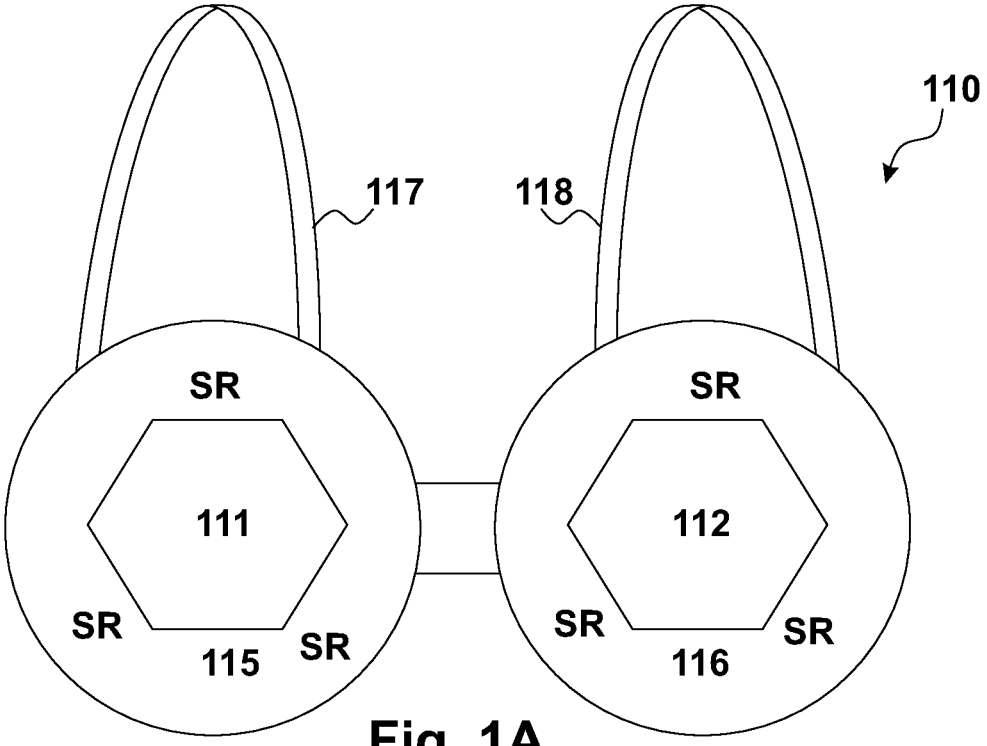
FIG. 1A is a schematic illustration of a front view of a bra, in accordance with some demonstrative embodiments of the present invention.

The Applicants have realized that a garment or a clothing article is typically formed of a fabric that fails to adequately encapsulate, or support, or hold-in-place, one or more particular body organs or body parts or body regions or body muscle(s) or body fat region.

For example, the Applicants have realized that a conventional bra typically provides some support to the breasts of a female wearer; but fail to provide adequate and/or sufficient support to such female wearer when she is running or jogging or exercising, and/or fails to prevent the breasts to move or bounce during such activities; thereby causing lack of comfort, lack of convenience, reduced athletic performance, interruptions in physical activities, and even medical problems.

The Applicants have further realized that a conventional "sports bra" typically provides excessive support to the breasts, merely by "squeezing" the breasts or "flattening" the breasts, in a manner that causes the wearer to feel discomfort or even pain; and in a manner that makes such "sports bra" painful or difficult to put on and/or to take off and/or to actually utilize during the physical activity, and/or in a manner that results in non-aesthetic appearance or non-desired "flattened" appearance of the breasts.

The Applicants have further realized that similar problems or disadvantages exist with regard to other articles of clothing that cover the breasts; for example, a shirt, a sports shirt, a yoga outfit, yoga shirt, aerobic shirt, exercise shirt, tank top, or the like.

The Applicants have further realized that similar problems or disadvantages exist with regard to other articles of clothing that cover the buttocks, and do not adequately support or hold-in-place the buttocks during physical activity, jogging, running, or even brisk walking; for example, in conventional underwear, underpants, panties, lingerie items, leggings, pants, yoga pants, aerobic pants, exercise pants, sports pants, or the like; including such items that are directed towards women or towards men or towards children or minors.

The Applicants have also realized that similar problems or disadvantages exist with regard to other articles of clothing that cover the testicles and/or the penis of a male wearer, and do not adequately support or hold-in-place the private parts of the male wearer during physical activity, jogging, running, or even brisk walking; for example, in conventional underwear, underpants, panties, lingerie items, leggings, pants, yoga pants, aerobic pants, exercise pants, sports pants, or the like; including such items that are directed towards women or towards men or towards children or minors.

The Applicants have realized that there is a need for a novel type of articles of clothing, which provide adequate support and/or hold-in-place a particular body organ or body part or body region (e.g., breasts; buttocks; testicles and penis), particularly during physical activity, jogging, running, or even brisk walking, as well as in everyday use, without causing non-desired "squeezing" or "flattening" of body organs, and without causing discomfort or inconvenience to wear them and/or to utilize them and/or to take them off and/or to put them on; and without the need to switch from an everyday item (e.g., an everyday bra) to a dedicated item (e.g., a sports bra) just for the simple activity of walking or rapid walking, or the like.

The present invention provides a variety of articles of clothing, which comprise one or more Encapsulation Zone(s) that are integrated therein as integral part of the clothing article, typically knitted integrally in a seam-less manner, as a single continuous piece of fabric, in a patch-less manner that avoids patching together multiple patches or fabric-pieces, in a manner that does not require stitching together multiple patches into a patched article of clothing; and/or in a manner that may further provide other or additional advantages, for example, adding a naturally "lifted" appearance or a more pleasing appearance to the body part being encapsulated (e.g., buttocks, breast).

In accordance with the present invention, a knitting machine (e.g., a seamless knitting machine able to knit a seamless garment or clothing article) is able to knit the entirety of the garment or clothing article, in a continuous process that is free of seams; and is able to perform continuous knitting that produces, in an integrated process, both the encapsulation zone(s) and the surrounding regions as well as other regions of the garment. In some embodiments, the entire clothing article is knitted by a single knitting machine in a single, seamless, knitting process that produces the encapsulation zone(s) as integral region(s) of the knitted garment. In other embodiments, optionally, an encapsulation zone, or some or all of the encapsulation zones, may be knitted separately from the other regions of the garment, and may be attached or connected to the other regions of the garment via suitable attachment or connection mechanisms.

Some embodiments may produce or knit the garment, including its integral and/or integrated and/or embedded encapsulation zone(s), by using one or more of: a knitting machine, a seamless knitting machine, a single jersey knitting machine, a double jersey knitting machine, a circular knitting machine, a flat knitting machine, a non-circular knitting machine, and/or other suitable machines.

The garment, and the encapsulation zone(s) that are integral part of the garment, may be produced or knitted from any suitable fabric or yarn or material, including for example, natural materials, synthetic materials, cotton, wool, silk, polyester, a combination of multiple materials, or the like.

Reference is made to FIG. 1A, which is a schematic illustration of a front view of a bra 110 in accordance with some demonstrative embodiments of the present invention; showing a first encapsulation zone 111 integrated in (and being integral part of) a first bra cup 115, and showing a second encapsulation zone 112 integrated in (and being integral part of) a second bra cup 116. Two bra straps 117-118 are shown, although in some embodiments the bra 110 may be a strapless bra, or may be a single-strap bra. Other region(s) of the bra 110, which surround the encapsulation zones 111-112, are denoted as "SR" for Surrounding Region(s).

Figure 1B:
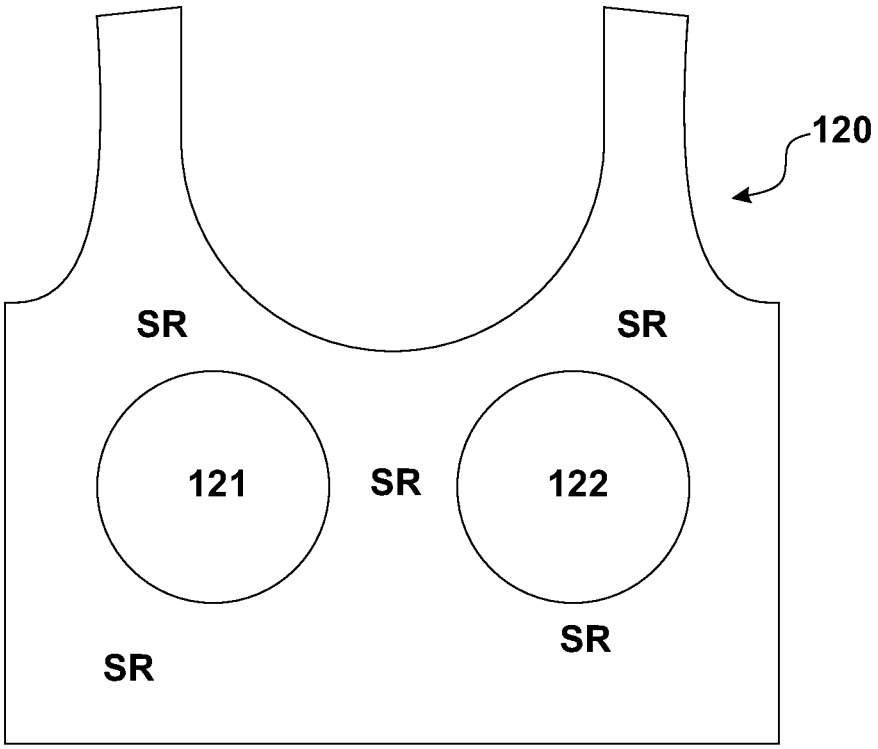
FIG. 1B is a schematic illustration of a front view of a sports bra, in accordance with some demonstrative embodiments of the present invention.

Reference is made to FIG. 1B, which is a schematic illustration of a front view of a sports bra 120 in accordance with some demonstrative embodiments of the present invention; showing a first encapsulation zone 121 integrated in (and being integral part of) a first front-side region of the sports bra, and showing a second encapsulation zone 122 integrated in (and being integral part of) a second front-side region of the sports bra 120. Other region(s) of the sports bra 120, which surround the encapsulation zones 121-122, are denoted as "SR" for Surrounding Region(s).

Figure 1C:
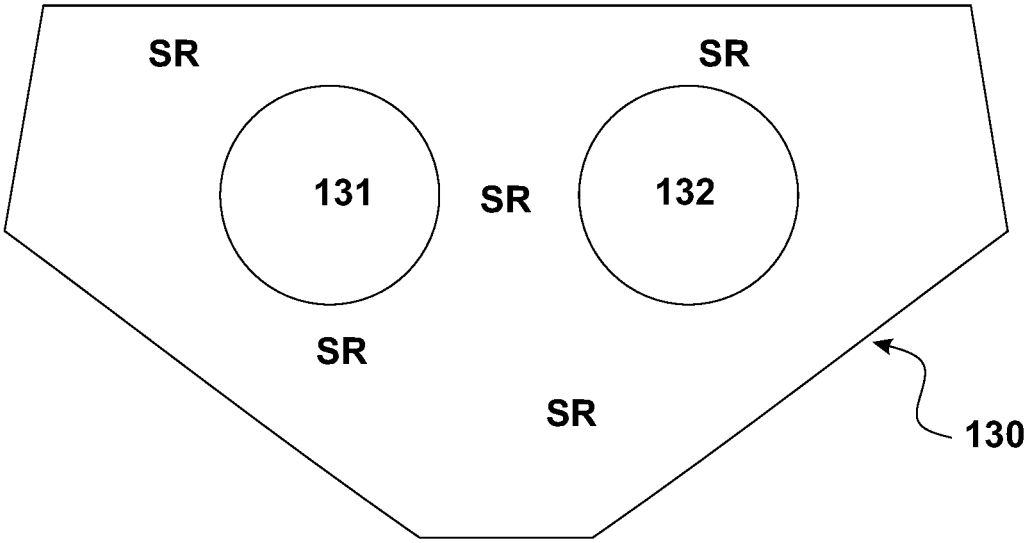
FIG. 1C is a schematic illustration of a rear view of female underwear, in accordance with some demonstrative embodiments of the present invention.

Reference is made to FIG. 1C, which is a schematic illustration of a rear view of female underwear 130 in accordance with some demonstrative embodiments of the present invention; showing a first encapsulation zone 131 integrated in (and being integral part of) a first rear-side region that covers part of a first buttock; and showing a second encapsulation zone 132 integrated in (and being integral part of) a second rear-side region that covers part of a second buttock. Other region(s) of the female underwear 130, which surround the encapsulation zones 131-132, are denoted as "SR" for Surrounding Region(s).

Figure 1D:
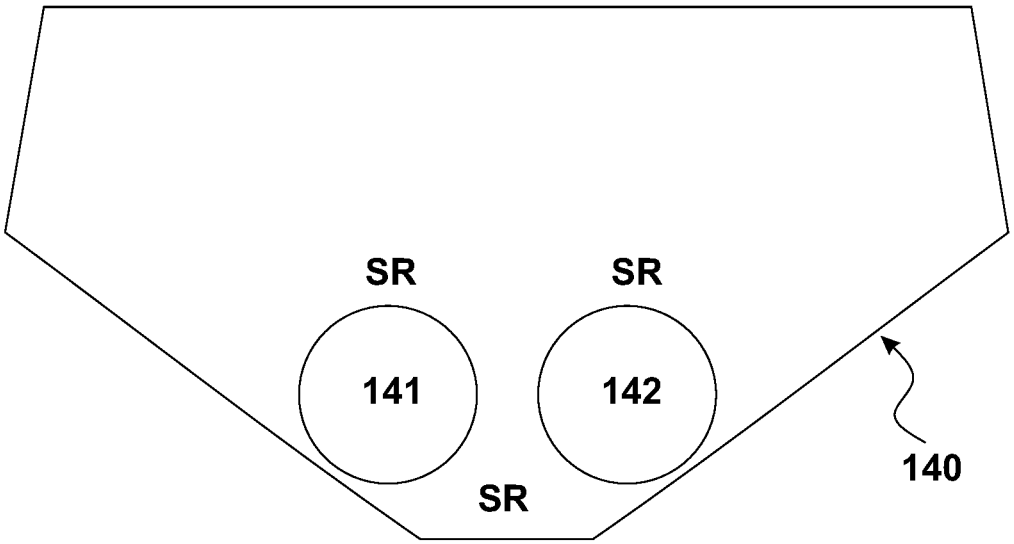
FIG. 1D is a schematic illustration of a front-side view of male underwear, in accordance with some demonstrative embodiments of the present invention.

Reference is made to FIG. 1D, which is a schematic illustration of a front-side view of male underwear 140 in accordance with some demonstrative embodiments of the present invention; showing a first encapsulation zone 141 integrated in (and being integral part of) a first front-side region that covers at least part of a first testicle; and showing a second encapsulation zone 142 integrated in (and being integral part of) a second front-side region that covers at least part of a second testicle. Optionally, a third encapsulation zone may be comprised in underwear 140, and may be integrated in (and integral part of) a third front-side region that covers at least part of the penis of the male wearer. Other region(s) of the male underwear 140, which surround the encapsulation zones 141-142, are denoted as "SR" for Surrounding Region(s).

Figure 1E:
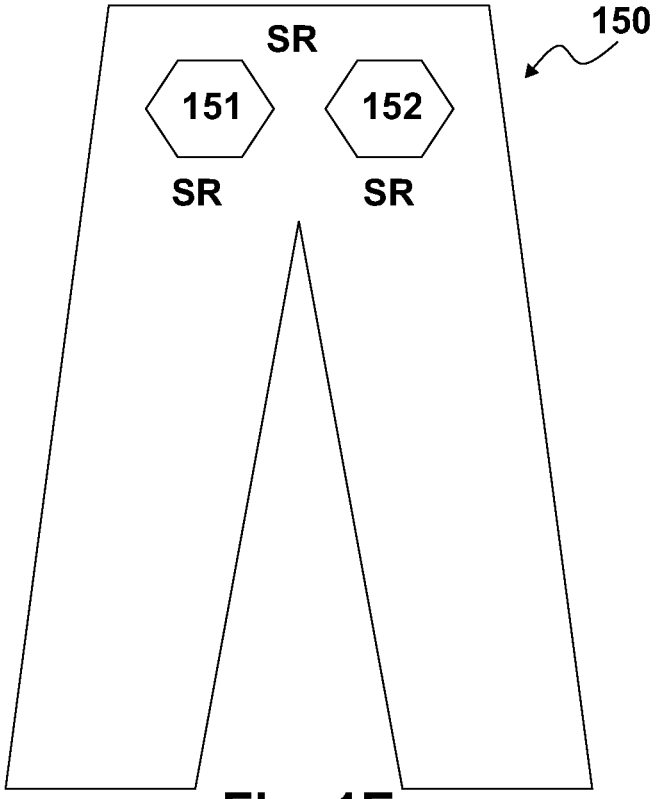
FIG. 1E is a schematic illustration of a rear view of a long-version of an article of clothing, in accordance with some demonstrative embodiments of the present invention.

Reference is made to FIG. 1E, which is a schematic illustration of a rear view of a long-version of an article of clothing 150 in accordance with some demonstrative embodiments of the present invention; for example, pants or leggings or "tights" or sweat-pants or yoga pants or aerobic pants or sport pants; showing a first encapsulation zone 151 integrated in (and being integral part of) a first rear-side region that covers part of a first buttock; and showing a second encapsulation zone 152 integrated in (and being integral part of) a second rear-side region that covers part of a second buttock. Other region(s) of the article of clothing 150, which surround the encapsulation zones 151-152, are denoted as "SR" for Surrounding Region(s).

Figure 1F:
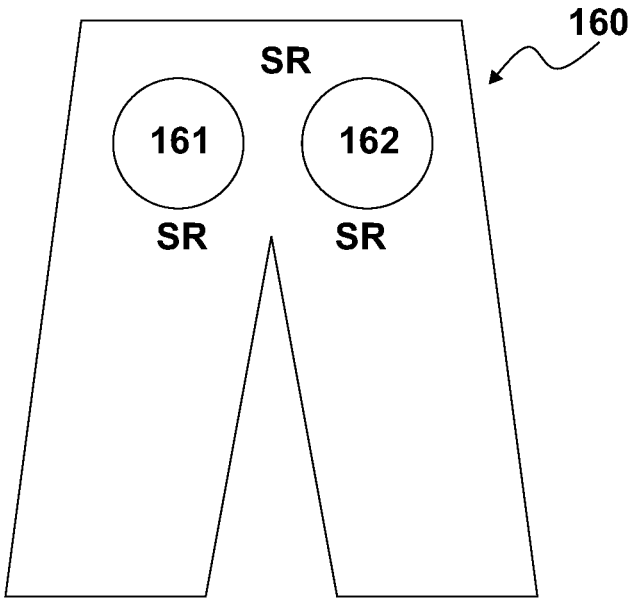
FIG. 1F is a schematic illustration of a rear view of a short-version of an article of clothing, in accordance with some demonstrative embodiments of the present invention.

Reference is made to FIG. 1F, which is a schematic illustration of a rear view of a short-version of an article of clothing 160 in accordance with some demonstrative embodiments of the present invention; for example, short pants or "shorts" or short sport pants; showing a first encapsulation zone 161 integrated in (and being integral part of) a first rear-side region that covers part of a first buttock; and showing a second encapsulation zone 162 integrated in (and being integral part of) a second rear-side region that covers part of a second buttock. Other region(s) of the article of clothing 160, which surround the encapsulation zones 161-162, are denoted as "SR" for Surrounding Region(s).

It is noted that the encapsulation zone(s) that are shown in FIGS. 1A through 1F have non-limiting examples of dimensions, sizes, forms, locations, aspect ratios and/or other characteristics; and that in accordance with the present invention, such encapsulation zone(s) may be located in other suitable locations of such (or other) articles of clothing, may have other suitable dimensions or sizes or aspect ratios or forms or characteristics.

Figure 2A:
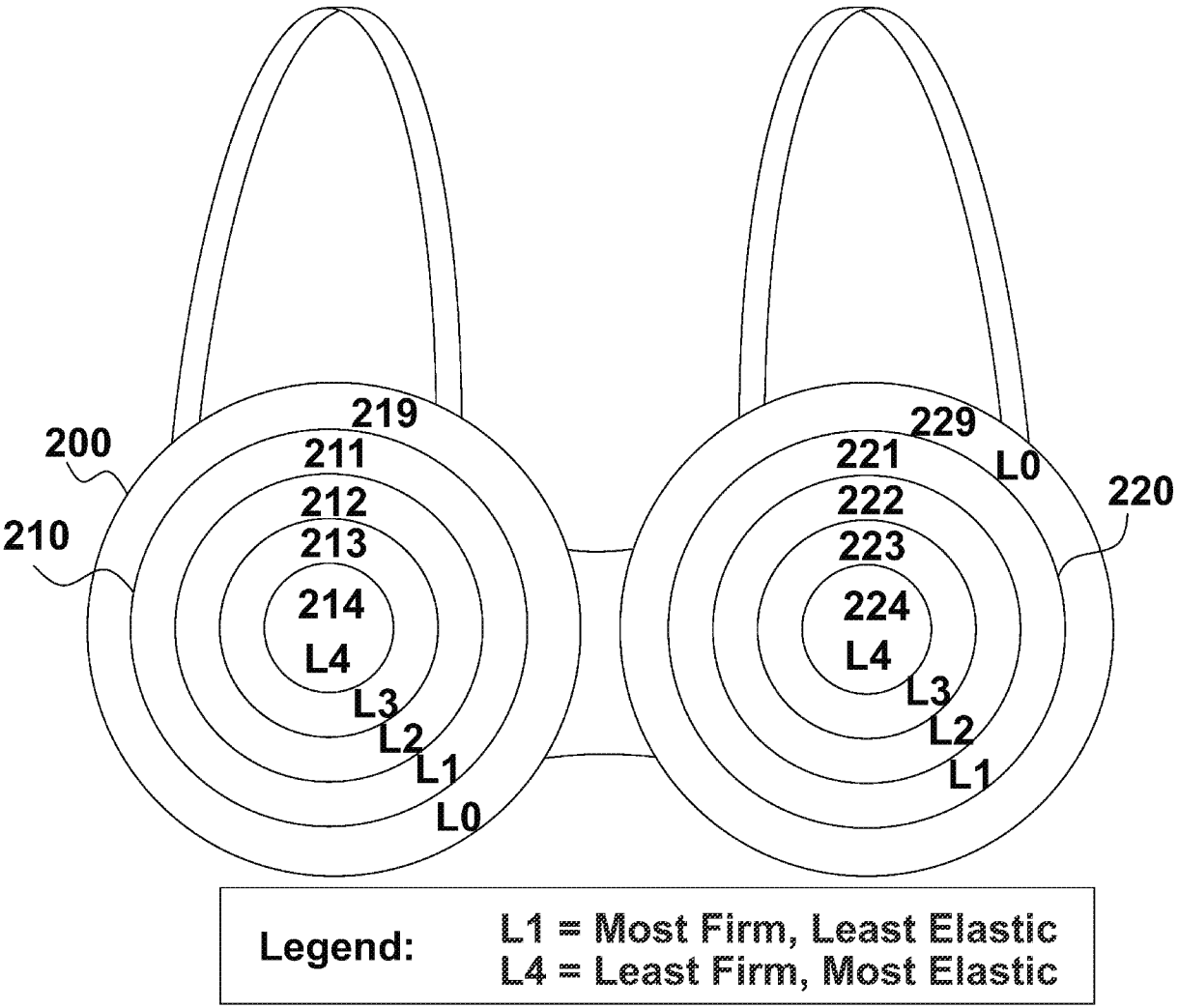
FIG. 2A is a schematic illustration of a bra having two encapsulation zones, in accordance with some demonstrative embodiments of the present invention.

Reference is made to FIG. 2A, which is a schematic illustration of a bra 200 having two encapsulation zones 210 and 220, in accordance with some demonstrative embodiments of the present invention. For example, encapsulation zone 210 is located within a surrounding region 219 of a first cup of the bra 200, and is integrated therein as an integral part thereof. Similarly, encapsulation zone 220 is located within a surrounding region 229 of a second cup of the bra 200, and is integrated therein as an integral part thereof.

In a demonstrative example, encapsulation zone 210 comprises four (or other number of) concentric or generally-concentric circular bands or circular regions or generally-circular encapsulation regions 211-214. Similarly, encapsulation zone 220 comprises four (or other number of) concentric or generally-concentric circular bands or circular regions or generally-circular encapsulation regions 221-224.

For purposes of clarity, the discussion herein may relate to encapsulation zone 210 and/or to its encapsulation regions 211-214 and/or to its respective surrounding region 219; similar features apply, respectively, to encapsulation zone 220, to encapsulation regions 221-224, and to surround region 229.

Each one of the encapsulation regions 211-214, has a level-of-elasticity or level-of-support or elasticity or rigidity or rigidness that is different from the corresponding level of the immediately-neighboring encapsulation regions and/or from the surrounding region.

For example, the level of elasticity of the encapsulation regions 211-214, gradually increases from the external encapsulation region to the internal encapsulation region; such that the most external encapsulation region 211 has a first level of elasticity (E1); then, the next, internal, encapsulation region 212 has a second level of elasticity (E2) which has greater elasticity (or, greater support, reduced rigidity, reduced firmness, reduced form-fitting characteristic) relative to the first level of elasticity (E1) of the first encapsulation region 211. Then, the next, further internal, encapsulation region 213 has a third level of elasticity (E3) which has greater elasticity (or, greater support, reduced rigidity, reduced firmness, reduced form-fitting characteristic) relative to the second level of elasticity (E2) of the second encapsulation region 212. Then, the next, most-internal, encapsulation region 214 has a fourth level of elasticity (E4) which has greater elasticity (or, greater support, reduced rigidity, reduced firmness, reduced form-fitting characteristic) relative to the third level of elasticity (E3) of the third encapsulation region 211.

The surrounding region 219, which surround or encircles or otherwise neighbors the entirety of the encapsulation zone 210, has a level of elasticity denoted E5. In some embodiments, the level of elasticity (E5) of the surrounding region 219, is identical or substantially identical to one of the particular levels of elasticity of a particular encapsulation region; for example, in some embodiments, E5 is identical to E4; or, in other embodiments, E5 is identical to E3; or, in other embodiments, E5 is identical to E2; or, in other embodiments, E5 is identical to E1. In yet other embodiments, the surrounding region 219 has a level of elasticity (E5) that is greater than level of elasticity E4 (and thus, also greater than any of the levels of elasticity E1, E2, E3 and E4). In still other embodiments, the surrounding region 219 has a level of elasticity (E5) that is smaller than level of elasticity E1 (and thus, also smaller than any of the levels of elasticity E1, E2, E3 and E4). In yet other embodiments, the surrounding region 219 has a level of elasticity (E5) that is between two neighboring levels of elasticity of two neighboring encapsulation regions; for example, in some embodiments, the value of E5 is between the values of E1 and E2; or in other embodiments, he value of E5 is between the values of E2 and E3; or in other embodiments the value of E5 is between the values of E3 and E4.

Each one of the encapsulation regions 211-214, is seamlessly and integrally knitted in an integral manner, via a seamless connection to the adjacent encapsulation region(s) and/or to the adjacent surround region 219; without utilization of any stitches or other connection methods among or between such regions. For example, each one of the encapsulation regions 211-214 is a seamless encapsulation knitting region; and the entirety of the encapsulation zone 210 is a seamless encapsulation knitting zone; such that the entirety of the encapsulation zone 210 is able to encapsulate, support, form-fit, or hold-in-place a particular body organ or body part or body region of the wearer, in a manner that is independent of other and/or surrounding body regions or body parts or body organs; particularly in a manner such that the external encapsulation region(s) are firmer and have more rigidity and more rigidness and more form-fitting characteristic and more body-support characteristic and less elasticity, relative to the more internal encapsulation region(s) of the encapsulation zone; thereby encapsulating the desired body part in a maximum comfortable manner, avoiding or preventing undesired movement of such body part, and providing the adequate support to that body part, without necessarily "squeezing" or "flattening" the entirety of the supported body part and/or at least a portion of the supported body part.

The encapsulation zone 210 need not necessarily be circular or generally circular; but rather, may have other suitable shapes or forms, for example, oval or elliptic, egg-shaped, square shaped, rectangular, triangular, pentagon shaped, hexagon shaped, octagon shaped, diamond shaped or kite shaped, trapezoid, parallelogram shaped, tetragon, rhombus, or the like. The Applicants have realized that in some embodiments, hexagon shape of the encapsulation zone may provide increased support and/or the most efficient encapsulation function, as hexagon is considered the most scientifically efficient and/or strongest packing shape (e.g., as in honey-combs).

Each one of the encapsulation regions 211-214 need not necessarily be circular or generally circular; but rather, may have other suitable shapes or forms, for example, oval or elliptic, egg-shaped, square shaped, rectangular, triangular, pentagon shaped, hexagon shaped, octagon shaped, diamond shaped or kite shaped, trapezoid, parallelogram shaped, tetragon, rhombus, or the like. The Applicants have realized that in some embodiments, hexagon shape of the encapsulation regions 211-214 may provide increased support and/or the most efficient encapsulation function, as hexagon is considered the most scientifically efficient and/or strongest packing shape (e.g., as in honey-combs).

The encapsulation regions 211-214 need not necessarily have the same shape; but rather, may have different shapes selected from a pre-defined group of shapes (e.g., oval or elliptic, egg-shaped, square shaped, rectangular, triangular, pentagon shaped, hexagon shaped, octagon shaped, diamond shaped or kite shaped, trapezoid, parallelogram shaped, tetragon, rhombus). For example, in some embodiments, at least one of the encapsulation regions 211-214 may have a first particular shape (e.g., circular band), whereas at least one other of the encapsulation regions may have a second, different, particular shape (e.g., hexagon band). In other embodiments, at least one of the encapsulation regions 211-214 may have a first particular shape (e.g., circular band), whereas at least two other of the encapsulation regions may have a second, different, particular shape (e.g., hexagon band). In still other embodiments, at least two of the encapsulation regions 211-214 may have a first particular shape (e.g., circular band), whereas at least two other of the encapsulation regions may have a second, different, particular shape (e.g., hexagon band). In some embodiments, at least the N most-external region(s) of the encapsulation region(s) 211-214, may have a first particular shape (e.g., circular band); whereas at least the M most-internal region(s) of the encapsulation region(s) 211-214, may have a second, different, particular shape (e.g., hexagon band). In still other embodiments, the encapsulating regions 211-214 may have alternating shapes; such that, for example, regions 211 and 213 may have a first particular shape (e.g., hexagon), while regions 212 and 214 may have a second, different, particular shape (e.g., oval). Other suitable shaping patterns may be used, to achieve a desired combination of body-support and elasticity.

The multiple encapsulation regions 211-214 need not necessarily be concentric, and need not necessarily have the same center-point or focal point(s), and/or need not necessarily be symmetric in their shape; rather, they may be asymmetric in their shape, and/or may be non-concentric, and/or may have different, non-identical, focal point(s) and/or center point. In some embodiments, the encapsulation regions may be linear or generally-linear in their shape, and/or may be shaped or arranged as parallel lines, or as parallel columns, or as a matrix or array of squares or other suitable shapes.

The multiple encapsulation regions 211-214 need not necessarily have the same, identical, width or band-width or region-width; but rather, may have different width or band-width or region-width values; may have gradually-increasing width values (e.g., such that the width of external region 211 is greater than the width of region 212, which in turn is greater than the width of region 213, which in turn is greater than the width of the most-internal region 214); or may have gradually-decreasing width values (e.g., such that the width of external region 211 is smaller than the width of region 212, which in turn is smaller than the width of region 213, which in turn is smaller than the width of the most-internal region 214); or may have alternating width-values (e.g., such that the width of region 211 is identical to the width of region 213, and such that the width of region 212 is identical to the width of region 214, and such that the width of region 211 is different from the width of region 212); or may have other pre-defined pattern of width values.

For demonstrative purposes, some of the drawings and/or portions of the text may relate to four encapsulation regions 211-214; however, this is only a non-limiting example of the present invention, and other embodiments may comprise an encapsulation zone having, for example, two encapsulation regions; or having a single encapsulation region; or having three encapsulation regions; or having five encapsulation regions; or having other suitable number of encapsulation regions.

In some embodiments, the entirety of the encapsulation zone 210 may feature a single type of knitting technique or knitting feature or knitting characteristic; for example, rib, pique, tack, mesh, or the like. In other embodiments, the entirety of the encapsulation zone 210 may feature two or more different types of knitting technique or knitting features or knitting characteristics; for example, rib, pique, tack, mesh, or the like; which may be arranged or divided across the different encapsulation regions 211-214. For example, one or more of the encapsulation regions 211-214 may have a first type of knitting characteristic(s); whereas, one or more other of the encapsulation regions 211-214 may have a second type of knitting characteristic(s). In some embodiments, at least one of the encapsulation regions 211-214 may have a first particular knitting characteristic (e.g., rib, pique, tack, mesh), whereas at least one other of the encapsulation regions may have a second, different, particular type of knitting characteristic(s) (e.g., rib, pique, tack, mesh). In other embodiments, at least one of the encapsulation regions 211-214 may have a first particular type of knitting characteristic(s) (e.g., rib, pique, tack, mesh), whereas at least two other of the encapsulation regions may have a second, different, particular type of knitting characteristic(s) (e.g., rib, pique, tack, mesh). In still other embodiments, at least two of the encapsulation regions 211-214 may have a first particular type of knitting characteristic(s) (e.g., rib, pique, tack, mesh), whereas at least two other of the encapsulation regions may have a second, different, particular type of knitting characteristic(s) (e.g., rib, pique, tack, mesh). In some embodiments, at least the N most-external region(s) of the encapsulation region(s) 211-214, may have a first particular type of knitting characteristic(s) (e.g., rib, pique, tack, mesh); whereas at least the M most-internal region(s) of the encapsulation region(s) 211-214, may have a second, different, particular type of knitting characteristic(s) (e.g., rib, pique, tack, mesh). In still other embodiments, the encapsulating regions 211-214 may have alternating shapes; such that, for example, regions 211 and 213 may have a first particular type of knitting characteristic(s) (e.g., rib, pique, tack, mesh), while regions 212 and 214 may have a second, different, particular type of knitting characteristic(s) (e.g., rib, pique, tack, mesh). Other suitable knitting characteristics patterns may be used, to achieve a desired combination of body-support and elasticity.

In some embodiments, the entirety of the encapsulation zone 210 may feature a single type of needle-based knitting technique or knitting feature or knitting characteristic, or a knitting feature that is achieved by utilizing a particular number of needles (e.g., machine-controlled needles), or by utilizing different needle way or needle ways; for example, 1×1 knitting, 1×2 knitting, 2×1 knitting, 2×2 knitting, 3×1 knitting, 1×3 knitting, 3×3 knitting, or the like. In other embodiments, the entirety of the encapsulation zone 210 may feature two or more different types of knitting technique or knitting features or knitting characteristics; for example, 1×1 knitting, 1×2 knitting, 2×1 knitting, 2×2 knitting, 3×1 knitting, 1×3 knitting, 3×3 knitting, or the like; which may be arranged or divided across the different encapsulation regions 211-214. For example, one or more of the encapsulation regions 211-214 may have a first type of knitting characteristic(s); whereas, one or more other of the encapsulation regions 211-214 may have a second type of knitting characteristic(s). In some embodiments, at least one of the encapsulation regions 211-214 may have a first particular knitting characteristic (e.g., 1×1 knitting, 1×2 knitting, 2×1 knitting, 2×2 knitting, 3×1 knitting, 1×3 knitting, 3×3 knitting, or the like), whereas at least one other of the encapsulation regions may have a second, different, particular type of knitting characteristic(s) (e.g., 1×1 knitting, 1×2 knitting, 2×1 knitting, 2×2 knitting, 3×1 knitting, 1×3 knitting, 3×3 knitting, or the like). In other embodiments, at least one of the encapsulation regions 211-214 may have a first particular type of knitting characteristic(s) (e.g., 1×1 knitting, 1×2 knitting, 2×1 knitting, 2×2 knitting, 3×1 knitting, 1×3 knitting, 3×3 knitting, or the like), whereas at least two other of the encapsulation regions may have a second, different, particular type of knitting characteristic(s) (e.g., 1×1 knitting, 1×2 knitting, 2×1 knitting, 2×2 knitting, 3×1 knitting, 1×3 knitting, 3×3 knitting, or the like). In still other embodiments, at least two of the encapsulation regions 211-214 may have a first particular type of knitting characteristic(s) (e.g., 1×1 knitting, 1×2 knitting, 2×1 knitting, 2×2 knitting, 3×1 knitting, 1×3 knitting, 3×3 knitting, or the like), whereas at least two other of the encapsulation regions may have a second, different, particular type of knitting characteristic(s) (e.g., 1×1 knitting, 1×2 knitting, 2×1 knitting, 2×2 knitting, 3×1 knitting, 1×3 knitting, 3×3 knitting, or the like). In some embodiments, at least the N most-external region(s) of the encapsulation region(s) 211-214, may have a first particular type of knitting characteristic(s) (e.g., 1×1 knitting, 1×2 knitting, 2×1 knitting, 2×2 knitting, 3×1 knitting, 1×3 knitting, 3×3 knitting, or the like); whereas at least the M most-internal region(s) of the encapsulation region(s) 211-214, may have a second, different, particular type of knitting characteristic(s) (e.g., 1×1 knitting, 1×2 knitting, 2×1 knitting, 2×2 knitting, 3×1 knitting, 1×3 knitting, 3×3 knitting, or the like). In still other embodiments, the encapsulating regions 211-214 may have alternating shapes; such that, for example, regions 211 and 213 may have a first particular type of knitting characteristic(s) (e.g., 1×1 knitting, 1×2 knitting, 2×1 knitting, 2×2 knitting, 3×1 knitting, 1×3 knitting, 3×3 knitting, or the like), while regions 212 and 214 may have a second, different, particular type of knitting characteristic(s) (e.g., 1×1 knitting, 1×2 knitting, 2×1 knitting, 2×2 knitting, 3×1 knitting, 1×3 knitting, 3×3 knitting, or the like). Other suitable knitting characteristics patterns may be used, to achieve a desired combination of body-support and elasticity.

In some embodiments, the entirety of the encapsulation zone 210 is knit with a basic ground yarn or a single ground yarn, without any additional knitting yarn and without any extra knitting yarn. In other embodiments, the entirety of the encapsulation zone 210 is knit with a basic ground yarn as well as with an additional knitting yarn or extra knitting yarn. In still other embodiments, one or more of the encapsulation regions 211-214 is knit with a basic ground yarn or a single ground yarn, without any additional knitting yarn and without any extra knitting yarn; whereas one or more other encapsulation regions 211-214 is knit with a basic ground yarn as well as with an additional knitting yarn or extra knitting yarn. Optionally, the extra knitting yarn, if used, is knit in accordance with any of the above-mentioned knitting techniques or knitting ways. Optionally, the extra knitting yarn may be or may comprise, for example, a natural yarn material, a synthetic yarn material, nylon, polyester, melting yarn, low melting yarn, cotton, wool, silk, or the like.

In some embodiments, each one of the encapsulation regions 211-214 provides a different level of elasticity or flexibility rigidity or rigidness or support or form-fitting, relative to each one of the other encapsulation regions 211-214, or at least relative to the one encapsulation region 211-214 or to the two encapsulation regions 211-214 that are immediately adjacent to that encapsulation region 211-214. This may be achieved, for example, by reducing the size, the density, the location, the frequency, the type, or other knitting characteristic(s) of the knitting stitch or the knitting "eye" in each such encapsulation region 211-214.

For example, the surrounding region 219 (e.g., the portion of the garment that is immediately adjacent to, or surrounds, the entire encapsulation zone 210) is formed of a fabric or yarn that is knitted at a particular density or elasticity-level (L0) by having knitting eyes such that each knitting eye in that region 219 has a size of M0 millimeters; the most external encapsulation region 211 is formed of a fabric or yarn that is knitted at a particular density or elasticity-level (L1) by having knitting eyes such that each knitting eye in that region 211 has a size of M1 millimeters, wherein M1>M0; the next encapsulation region 212 is formed of a fabric or yarn that is knitted at a particular density or elasticity-level (L2) by having knitting eyes such that each knitting eye in that region 212 has a size of M2 millimeters, wherein M2>M1; the next encapsulation region 213 is formed of a fabric or yarn that is knitted at a particular density or elasticity-level (L3) by having knitting eyes such that each knitting eye in that region 213 has a size of M3 millimeters, wherein M3>M2; the next, most-internal, encapsulation region 214 is formed of a fabric or yarn that is knitted at a particular density or elasticity-level (L4) by having knitting eyes such that each knitting eye in that region 214 has a size of M4 millimeters, wherein M4>M3. Accordingly, the surrounding region 219 and the four encapsulation regions 211-214 have different size of knitting eyes, such that M0<M1<M2<M3<M4.

In a demonstrative example, for a particular value of M0 (size of knitting eye in the surrounding region), the knitting-eye size M1 is equal to 1.03*M0; and, the knitting-eye size M2 is equal to 1.05*M0; and, the knitting-eye size M3 is equal to 1.08*M0; and, the knitting-eye size M4 is equal to 1.11*M0. These are only non-limiting examples; and other suitable values or ratios may be used.

In accordance with the present invention, the change in the size of the knitting eye in each of those regions, may cause, or may contribute to, the different elasticity level or flexibility level or firmness level or support level of those regions; for example, such that the elasticity levels would relate to each other as L1<L2<L3<L4, namely, level of elasticity or flexibility of each region is greater than the region(s) that surround it or that are external to it.

In some embodiments, the level of elasticity (L0) of the surrounding region 219, is greater than L4, such that (L0>L4. In other embodiments, L3<(L0<L4. In other embodiments, L2<(L0<L3. In other embodiments, L1<(L0<L2. In still other embodiments, other suitable relations may be used among the different level of elasticity.

For example, the surrounding region 219 (e.g., the portion of the garment that is immediately adjacent to, or surrounds, the entire encapsulation zone 210) is formed of a fabric that is knitted at a particular density or elasticity-level, having N knitting stitches or knitting "eyes" per square-inch or per square-centimeter or per other pre-defined area. Then, the most external encapsulation region 211 has, for example, 8 percent less knitting stitches or knitting "eyes", relative to those of the surrounding region 219, such that if the surrounding region 219 has N knitting stitches or N knitting "eyes" (per area) then the encapsulation region 211 has 0.92 N knitting stitches or 0.92 N knitting eyes (per area). Similarly, the next encapsulation region 212 has, for example, 6 percent less knitting stitches or knitting "eyes", relative to those of the surrounding region 219, such that if the surrounding region 219 has N knitting stitches or N knitting "eyes" (per area) then the encapsulation region 212 has 0.94 N knitting stitches or 0.94 N knitting eyes (per area). Similarly, the next encapsulation region 213 has, for example, 4 percent less knitting stitches or knitting "eyes", relative to those of the surrounding region 219, such that if the surrounding region 219 has N knitting stitches or N knitting "eyes" (per area) then the encapsulation region 213 has 0.96 N knitting stitches or 0.96 N knitting eyes (per area). Similarly, the next encapsulation region 214 has, for example, 2 percent less knitting stitches or knitting "eyes", relative to those of the surrounding region 219, such that if the surrounding region 219 has N knitting stitches or N knitting "eyes" (per area) then the encapsulation region 212 has 0.92 N knitting stitches or 0.92 N knitting eyes (per area). In other embodiments, the gradual decrease need not be in fixed intervals (e.g., 2 percent-point intervals in the above example), but rather, may be non-fixed intervals (e.g., 0.90 N in the external region 211; then 0.94 N; then 0.97 N; then 0.99 N). In still other embodiments, the gradual modification need not be a decreasing interval, but rather, may be a gradually increasing interval (e.g., 0.98 N in the external region 211; then 0.97 N in region 212; then 0.95 N in region 213; then 0.93 N in region 214). Other suitable values or percentage-values or ratios may be used.

Additionally or alternatively, for example, the surrounding region 219 (e.g., the portion of the garment that is immediately adjacent to, or surrounds, the entire encapsulation zone 210) is formed of a fabric that is knitted at a particular density or elasticity-level, having yarn knitted with knitting "eyes", each such knitting eye being of a diameter or a radius or a length of K millimeters. Then, the most external encapsulation region 211 has, for example, knitting eyes that are 8 percent smaller than K millimeters, namely their respective size (e.g., diameter or radius or length) is 0.92 K millimeters each. Then, the next encapsulation region 212 has, for example, knitting eyes that are 6 percent smaller than K millimeters, namely their respective size (e.g., diameter or radius or length) is 0.94 K millimeters each. Then, the next encapsulation region 213 has, for example, knitting eyes that are 4 percent smaller than K millimeters, namely their respective size (e.g., diameter or radius or length) is 0.96 K millimeters each. Then, the next encapsulation region 214 has, for example, knitting eyes that are 2 percent smaller than K millimeters, namely their respective size (e.g., diameter or radius or length) is 0.98 K millimeters each. In other embodiments, the gradual decrease need not be in fixed intervals (e.g., 2 percent-point intervals in the above example), but rather, may be non-fixed intervals (e.g., 0.90 K in the external region 211; then 0.94 K; then 0.97 K; then 0.99 K). In still other embodiments, the gradual modification need not be a decreasing interval, but rather, may be a gradually increasing interval (e.g., 0.98 K in the external region 211; then 0.97 K in region 212; then 0.95 K in region 213; then 0.93 K in region 214). Other suitable values or percentage-values or ratios may be used.

Each one of the encapsulation regions 211-214, is not a stand-alone patch or fabric-segment that it produced separately and is then stitched or otherwise connected to other "patches". Rather, the entirety of the encapsulation zone 210, and all of the encapsulation regions 211-214, and the surrounding region 219, are all a single, continuous, fabric or garment, all integrally fabricated as an integral and continuous knitted region which is seam-less; in which the different regions (211, 212, 213, 214, 219) merely differ from each other by a knitting characteristic (or, by multiple knitting characteristics) which thus cause each region of those regions to have a different level-of-elasticity or level-of-support relative to the other regions and/or relative to at least its immediately-neighboring region(s).

In some embodiments, the encapsulation zone 210 may be knit into any suitable silhouette, and/or may be knitted with any kind of synthetic and/or natural yarns. Accordingly, the garment may feature 100% seamless knitting, or may be a hybrid garment with combination of both seamless knitting with other cut-and-sew garment region(s) or fabrics.

In some embodiments, each one of the regions (211, 212, 213, 214, and 219) has the same, or generally similar, thickness or fabric-thickness; and/or has the same, or generally similar, number and type of fabric layer(s). For example, all of the regions (211, 212, 213, 214, and 219) have uniform thickness (e.g., 5 millimeters of fabric thickness), and/or have the same number of fabric layers (e.g., a single fabric layer; or alternatively, two fabric layers), and/or have the same type of fabric (e.g., all the regions formed of cotton; or alternatively, all the regions formed of a particular ratio of blend of cotton and polyester).

In other embodiments, at least one of the regions (211, 212, 213, 214, and 219) may have different thickness or fabric-thickness; and/or different number and/or type of fabric layer(s). For example, all of the encapsulation regions 211-214 may have a first value of fabric-thickness (e.g., 5 millimeters) and/or a first value of fabric layers (e.g., one fabric layer); whereas the surrounding region 219 may have a second, different, value of fabric-thickness (e.g., 6 millimeters) and/or a second, different, value of fabric layers (e.g., two fabric layers).

In still embodiments, at least one of the encapsulation regions 211-214 may have different thickness or fabric-thickness, and/or different number and/or type of fabric layer(s), relative to at least one other of the encapsulation regions 211-214. For example, the most-external encapsulation region 211 may be formed of two fabric layers and/or may have a total thickness of 8 millimeters; whereas the most-internal encapsulation region 214 may be formed of a single fabric layer and/or may have a total thickness of 6 millimeters.

In some embodiments, the encapsulation zone 210 and the surrounding region 219 are knitted and fabricated in a single, continuous, seam-less process; and are formed as a single, continuous, seam-less product or garment. Optionally, any suitable type of fabric may be used; optionally, laminations may be used; optionally, any suitable knitting or weaving machines or techniques may be used, utilizing any suitable gauge or diameter.

In some embodiments, the encapsulation zone 210 is a symmetric or double-symmetric zone or pattern or shape, such as a circle or a hexagon; such that symmetry is maintained along at least one axis, or along at least two axis lines, or along at least a vertical axis and a horizontal axis. In other embodiments, the encapsulation zone 210 is a non-symmetric zone or pattern or shape, or only a partially-symmetric zone or shape or pattern; such as oval or egg-shaped, or star shaped, or the like.

In some embodiments, each one of the encapsulation regions 211-214 is a symmetric or double-symmetric zone or pattern or shape, such as a circle or a hexagon; such that symmetry is maintained along at least one axis, or along at least two axis lines, or along at least a vertical axis and a horizontal axis. In other embodiments, each one of the encapsulation regions 211-214 is a non-symmetric zone or pattern or shape, or only a partially-symmetric zone or shape or pattern; such as oval or egg-shaped, or star shaped, or the like.

In some embodiments, two or more encapsulation zones may be comprised in a single garment or in a single article of clothing. In some implementations, the multiple encapsulation zones may be located or positioned at generally symmetrical locations; for example, a first encapsulation zone at the right-side cup of a bra, and a second encapsulation zone at the left-side cup of that bra; wherein the two encapsulation zones are generally identical to each other, or are symmetrical to each other, or are flipped or mirrored relative to each other. In other embodiments, two or more encapsulation zones may be comprised in one single garment, but need not necessarily be of the same size or dimensions or in symmetrical locations; for example, enabling to produce men's underwear or shorts or boxers or briefs in which a right-side encapsulation zone is different from a left-side encapsulation zone, or is located in non-symmetrical positions or locations of the garment.

In some embodiments, the encapsulation zone 210 is featured only at the internal side of the garment, or only in the internal or the most-internal fabric-layer which is intended to touch the body of the human wearer and/or is intended to face inwardly towards the body of the human wearer. In other embodiments, the encapsulation zone 210 is featured only at the external side of the garment, or only in the external or the most-external fabric-layer which is intended not to touch the body of the human wearer or which is facing outwardly or away from the human body. In still other embodiments, the encapsulation zone 210 is featured at both the external side of the garment and the internal side of the garment; or, is featured across all the fabric-layers of the garment (e.g., the internal fabric layer(s) that face inwardly, and the external fabric layer(s) that face outwardly, relative to the human body).

Figure 2B:
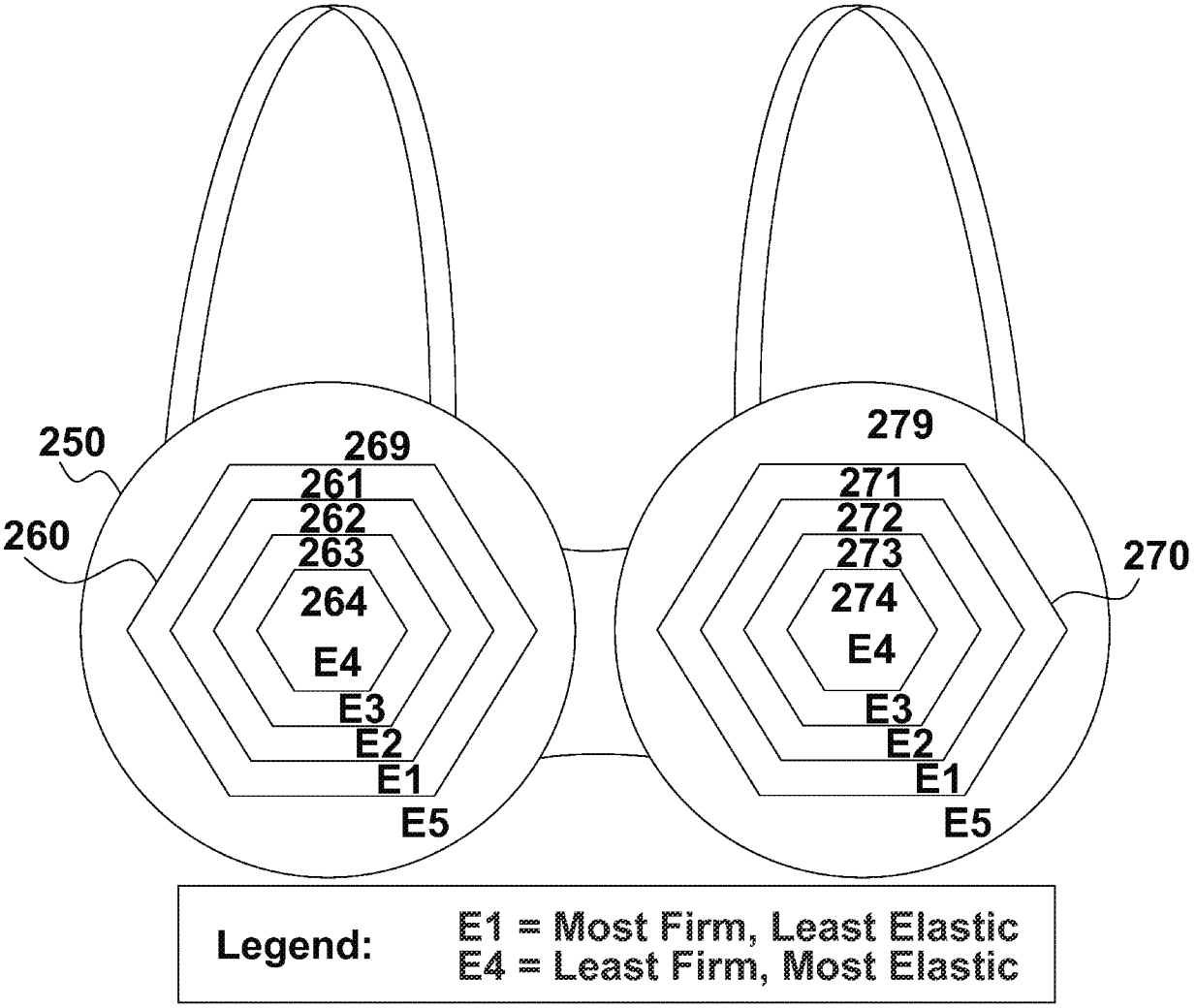
FIG. 2B is a schematic illustration of a bra, in accordance with some demonstrative embodiments of the invention.

Reference is made to FIG. 2B, which is a schematic illustration of a bra 250 in accordance with some demonstrative embodiments of the invention. A first cup of bra 250 comprises an encapsulation zone 260; and a second cup of bra 250 comprises an encapsulation zone 270. In a demonstrative embodiment, encapsulation zone 260 comprises four encapsulation regions 261-264, which may be generally-concentric, perfect hexagons or hexagon bands; and encapsulation zone 260 is surrounded by surrounding region 269. Similarly, encapsulation zone 270 comprises four encapsulation regions 271-274, which may be generally-concentric, perfect hexagons or hexagon bands; and encapsulation zone 270 is surrounded by surrounding region 279.

Figure 3A:
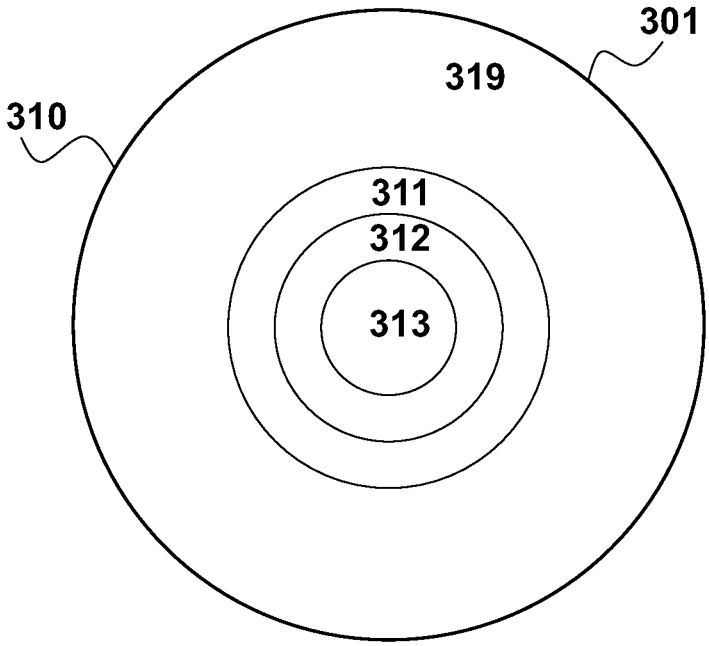
FIG. 3A is a schematic illustration of a cup of a bra, in accordance with some demonstrative embodiments of the invention.

Reference is made to FIG. 3A, which is a schematic illustration of a cup 301 of a bra, in accordance with some demonstrative embodiments of the invention. Cup 301 comprises an encapsulation zone 310, surrounded by a surrounding region 319. The encapsulation zone 310 comprises, for example, three encapsulation regions 311-313, which are generally-concentric circular areas or circular bands. Other suitable shapes or areas may be used, and other suitable number or locations of encapsulation regions may be used.

Figure 3B:
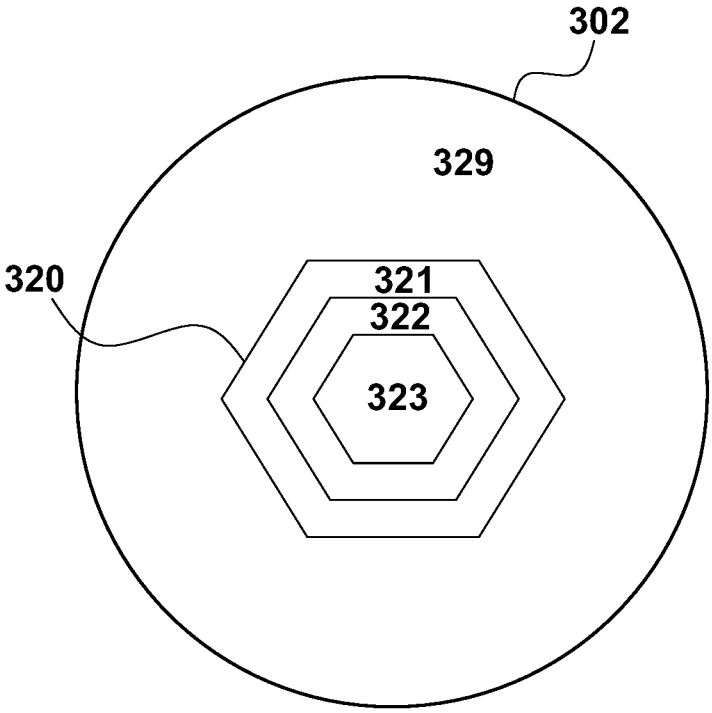
FIG. 3B is a schematic illustration of a cup of a bra, in accordance with some demonstrative embodiments of the invention.

Reference is made to FIG. 3B, which is a schematic illustration of a cup 302 of a bra, in accordance with some demonstrative embodiments of the invention. Cup 302 comprises an encapsulation zone 320, surrounded by a surrounding region 329. The encapsulation zone 320 comprises, for example, three encapsulation regions 321-323, which are generally-concentric hexagon areas or hexagon bands. Other suitable shapes or areas may be used, and other suitable number or locations of encapsulation regions may be used.

Figure 3C:
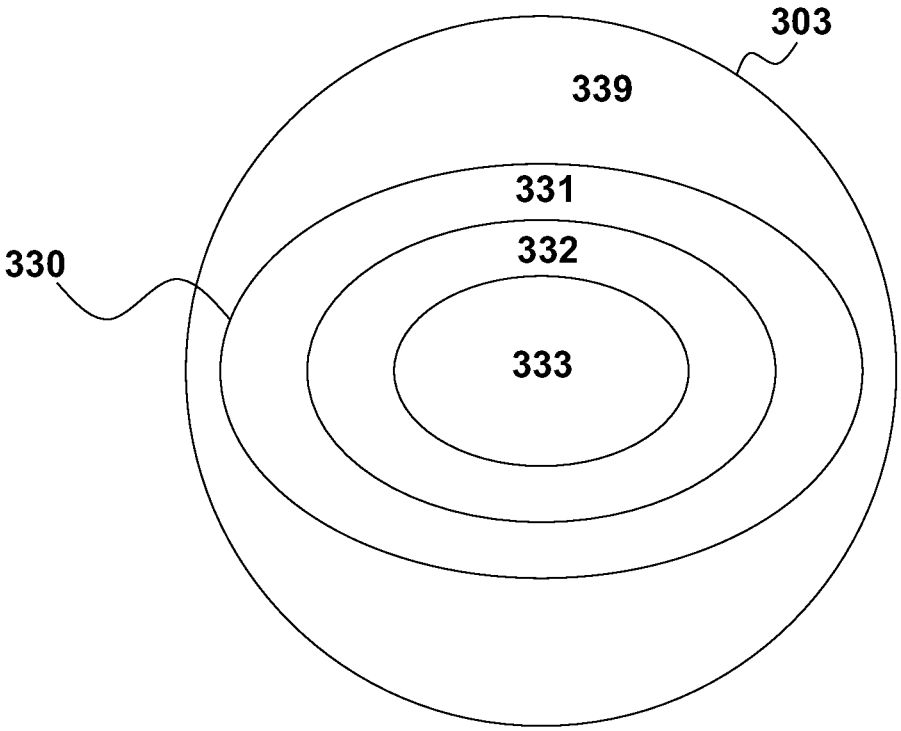
FIG. 3C is a schematic illustration of a cup of a bra, in accordance with some demonstrative embodiments of the invention.

Reference is made to FIG. 3C, which is a schematic illustration of a cup 303 of a bra, in accordance with some demonstrative embodiments of the invention. Cup 303 comprises an encapsulation zone 330, surrounded by a surrounding region 339. The encapsulation zone 330 comprises, for example, three encapsulation regions 331-333, which are generally-concentric generally-horizontal oval shapes or oval areas or oval bands. Other suitable shapes or areas may be used, and other suitable number or locations of encapsulation regions may be used.

Figure 3D:
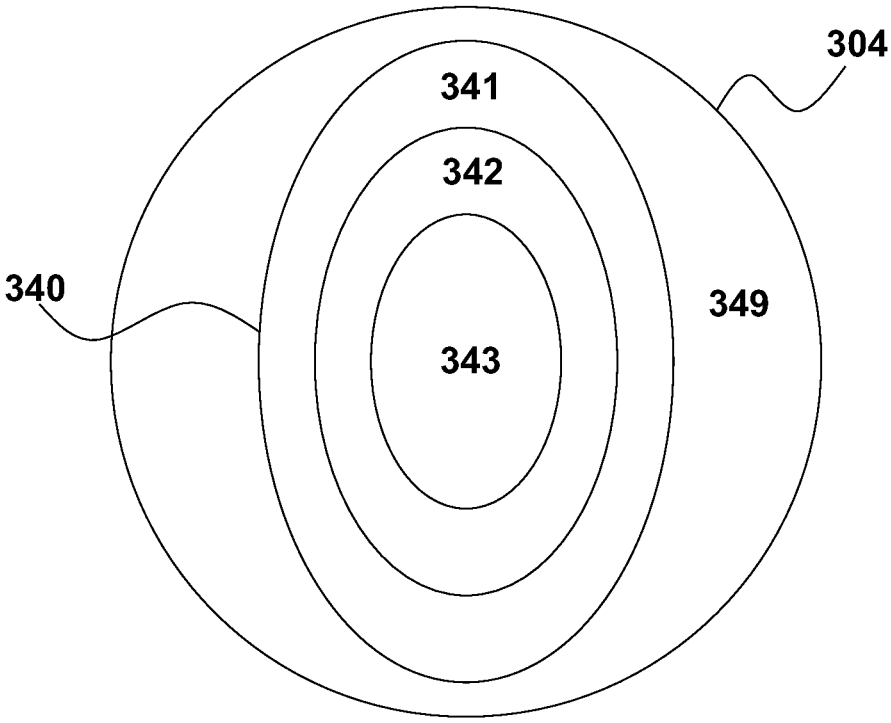
FIG. 3D is a schematic illustration of a cup of a bra, in accordance with some demonstrative embodiments of the invention.

Reference is made to FIG. 3D, which is a schematic illustration of a cup 304 of a bra, in accordance with some demonstrative embodiments of the invention. Cup 304 comprises an encapsulation zone 340, surrounded by a surrounding region 349. The encapsulation zone 340 comprises, for example, three encapsulation regions 341-343, which are generally-concentric generally-vertical oval shapes or oval areas or oval bands. Other suitable shapes or areas may be used, and other suitable number or locations of encapsulation regions may be used.

Figure 3E:
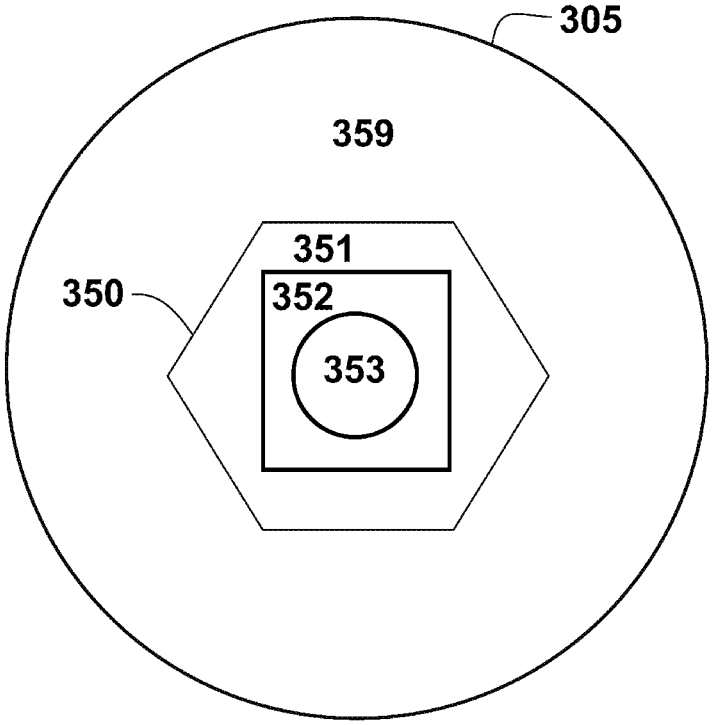
FIG. 3E is a schematic illustration of a cup of a bra, in accordance with some demonstrative embodiments of the invention.

Reference is made to FIG. 3E, which is a schematic illustration of a cup 305 of a bra, in accordance with some demonstrative embodiments of the invention. Cup 305 comprises an encapsulation zone 350, surrounded by a surrounding region 359. The encapsulation zone 350 is generally concentric relative to cup 305. The encapsulation zone 350 comprises, for example, three encapsulation regions 351-353, which are generally-concentric relative to each other and also relative to the cup 305. The three encapsulation regions 351-353 have shapes, areas, and sizes that are different from each other; for example, encapsulation region 351 is as an area trapped between a hexagon and an internal square that are concentric to each other; whereas encapsulation region 352 is a different area trapped between a square and an internal circle that are concentric to each other; whereas encapsulation region 353 is yet a different area trapped within said circle. Other suitable shapes or areas or sizes or ratios may be used, and other suitable number or locations of encapsulation regions may be used.

Figure 3F:
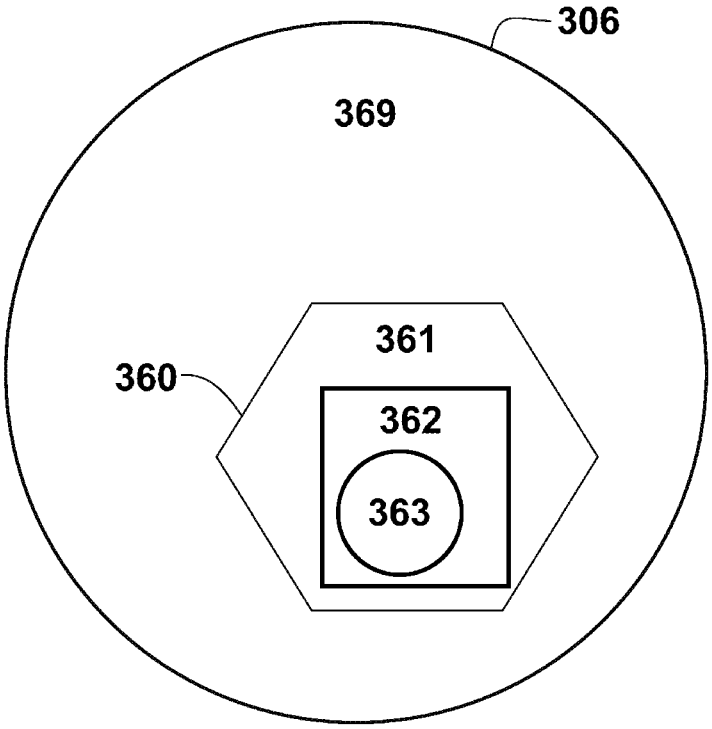
FIG. 3F is a schematic illustration of a cup of a bra, in accordance with some demonstrative embodiments of the invention.

Reference is made to FIG. 3F, which is a schematic illustration of a cup 306 of a bra, in accordance with some demonstrative embodiments of the invention. Cup 306 comprises an encapsulation zone 360, surrounded by a surrounding region 369. The encapsulation zone 360 is non-concentric relative to the cup 306. The encapsulation zone 360 comprises, for example, three encapsulation regions 361-363, which are generally non-concentric relative to each other and also relative to the cup 306. The three encapsulation regions 361-363 have shapes, areas, and sizes that are different from each other; for example, encapsulation region 361 is as an area trapped between a hexagon and an internal square which are non-concentric to each other; whereas encapsulation region 362 is a different area trapped between a square and an internal circle which are non-concentric to each other; whereas encapsulation region 363 is yet a different area trapped within said circle. Other suitable shapes or areas or sizes or ratios may be used, and other suitable number or locations of encapsulation regions may be used.

Figure 4A:
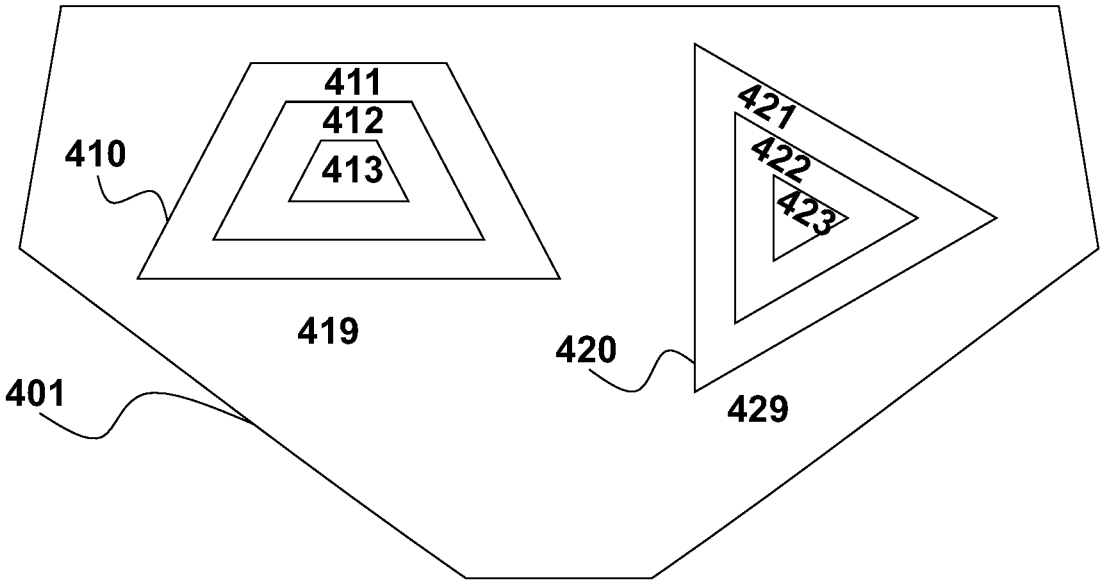
FIG. 4A is a schematic illustration of rear side of a female underwear, in accordance with some demonstrative embodiments of the invention.

Reference is made to FIG. 4A, which is a schematic illustration of rear side of a female underwear 401, in accordance with some demonstrative embodiments of the invention. Underwear 401 comprises a first encapsulation zone 410, surrounded by a surrounding region 419. The encapsulation zone 410 comprises, for example, three encapsulation regions 411-413, which are generally-concentric trapezoid areas or trapezoid bands. Additionally or alternatively, underwear 401 comprises a second encapsulation zone 420, surrounded by a surrounding region 429. The encapsulation zone 420 comprises, for example, three encapsulation regions 421-423, which are generally-concentric triangular areas or triangular bands. Other suitable shapes or areas may be used, and other suitable number or locations of encapsulation regions may be used.

Figure 4B:
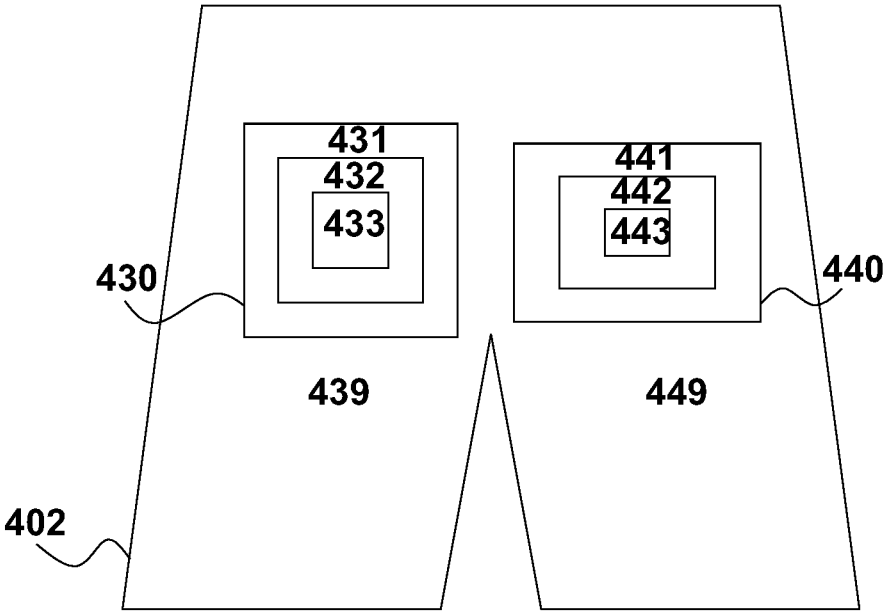
FIG. 4B is a schematic illustration of rear side of short pants, in accordance with some demonstrative embodiments of the invention.

Reference is made to FIG. 4B, which is a schematic illustration of rear side of short pants 402, in accordance with some demonstrative embodiments of the invention. Short pants 402 comprise a first encapsulation zone 430, surrounded by a surrounding region 439. The encapsulation zone 430 comprises, for example, three encapsulation regions 431-433, which are generally-concentric squares or square-shaped bands. Additionally or alternatively, short pants 402 comprise a second encapsulation zone 440, surrounded by a surrounding region 449. The encapsulation zone 440 comprises, for example, three encapsulation regions 441-443, which are generally-concentric rectangular areas or rectangular bands. Other suitable shapes or areas may be used, and other suitable number or locations of encapsulation regions may be used.

Figure 4C:
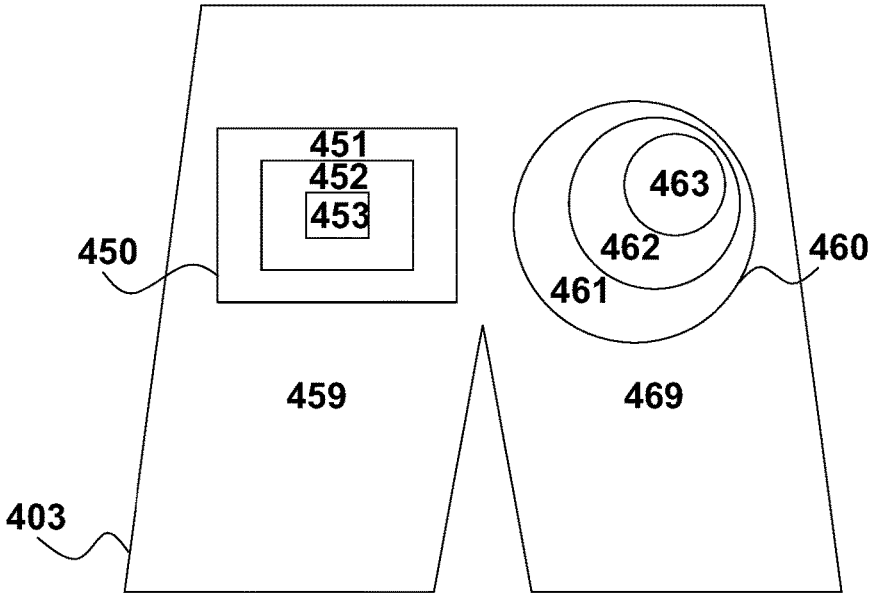
FIG. 4C is a schematic illustration of rear side of a female underwear, in accordance with some demonstrative embodiments of the invention.

Reference is made to FIG. 4C, which is a schematic illustration of rear side of a female underwear 403, in accordance with some demonstrative embodiments of the invention. Underwear 403 comprises a first encapsulation zone 450, surrounded by a surrounding region 459. The encapsulation zone 450 comprises, for example, three encapsulation regions 451-453, which are non-concentric rectangular areas or rectangular bands or rectangular frames. Additionally or alternatively, underwear 403 comprises a second encapsulation zone 460, surrounded by a surrounding region 469. The encapsulation zone 460 comprises, for example, three encapsulation regions 461-463, which are non-concentric and/or non-symmetrical shapes or areas or bands. Other suitable shapes or areas may be used, and other suitable number or locations of encapsulation regions may be used.

Figure 4D:
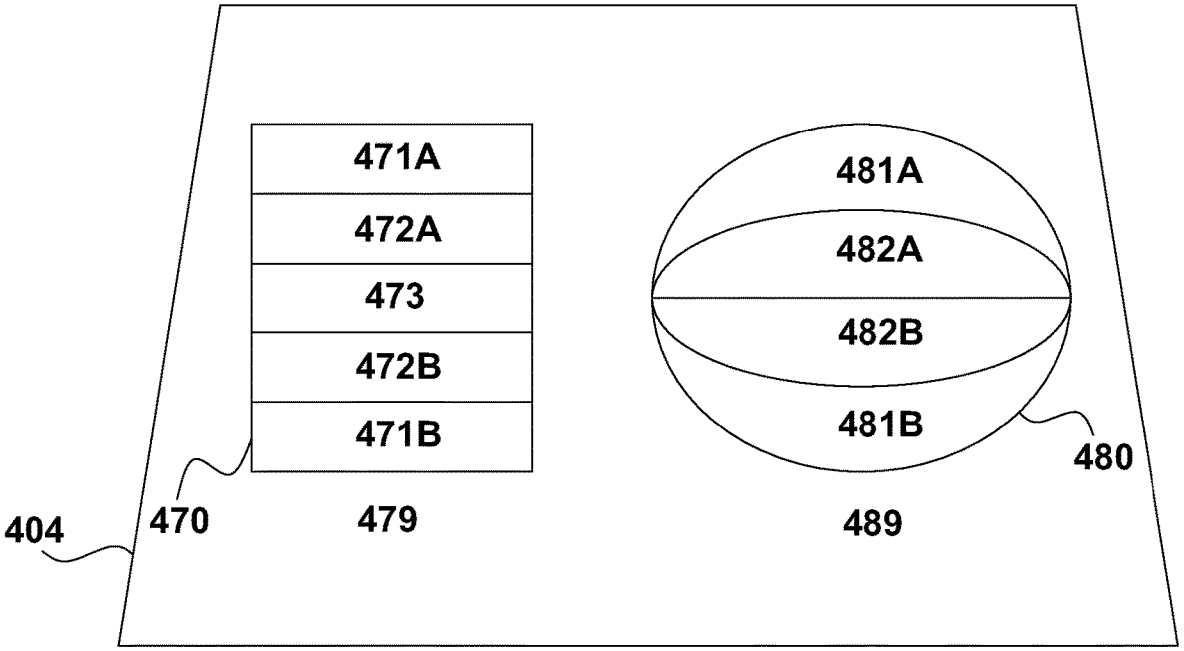
FIG. 4D is a schematic illustration of rear side of a skirt, in accordance with some demonstrative embodiments of the invention.

Reference is made to FIG. 4D, which is a schematic illustration of rear side of a skirt 404, in accordance with some demonstrative embodiments of the invention. Skirt 404 comprises a first encapsulation zone 470, surrounded by a surrounding region 479. The encapsulation zone 470 comprises, for example: two most-external encapsulation regions 471A and 471B, having a same level of elasticity; two intermediate encapsulation regions 472A and 472B, having a same level of elasticity which is greater than the level of elasticity of regions 471A and 471B; and a central encapsulation region 473 having a level of elasticity that is greater than that of regions 472A and 472B. Additionally or alternatively, skirt 404 comprises a second encapsulation zone 480, surrounded by a surrounding region 489. The encapsulation zone 480 comprises, for example: two encapsulation regions 481A and 481B, having a same level of elasticity; and two encapsulation regions 482A and 482B, having a same level of elasticity which is greater than the level of elasticity of regions 481A and 481B. Other suitable shapes or areas may be used, and other suitable number or locations of encapsulation regions may be used.

Some embodiments may comprise a method and a system for producing a garment; as well as a garment-producing apparatus or system, or a production-line system and method.

For example, a knitting machine may comprise one or more selectively-controlled needles, whose knitting operations are controlled via a central control unit and/or based on a pre-defined knitting pattern and/or knitting instructions and/or knitting scheme and/or knitting program that are pre-defined for such needles (e.g., via a computerized terminal or work-station, or a computerized interface). In some embodiments, multiple discrete feeds are included and can be selectively and/or separately controlled for selective knitting and/or for selective feeding of which yarn(s) each such feeds is fed for knitting, and different needles counts (e.g., from a single needle, to dozens or hundreds or even thousands of needles).

The knitting machine may comprise, for example: (a) a surrounding regions knitting unit, able to knit or produce the surrounding region 219 and/or the remainder of the garment other than the encapsulation zone(s); and (b) an encapsulation zone knitting unit, able to knit or produce the encapsulation zone 210 integrally within or near or in direct continuation to the surrounding region 219. Optionally, the encapsulation zone knitting unit may comprise one or more encapsulation region knitting sub-unit(s), able to selectively produce and/or knit one or more of the encapsulation regions 211-214, based on pre-defined knitting characteristics that characterize that particular encapsulation region(s) 211-214. In some embodiments, the above-mentioned unit and sub-unit(s) may optionally be implemented as a knitting machine that is associated with one or more selectively-operable knitting needle(s) and/or yarn-feeding unit(s), and further associated with a control workstation having a controller or processor able to selectively and dynamically control and/or modify the location, timing and/or characteristic of the knitting, and to perform continuous knitting of an integrated or monolithic garment having both the encapsulation zone 210 and its surrounding region 219, and having the encapsulation regions 211-214 with their particular knitting characteristics.

In some embodiments, the knitting machine may comprise a fabric elasticity (or fabric rigidity) modifier unit, able to produce or knit a fabric having a pre-defined level of elasticity or flexibility or rigidity or rigidness; and that unit may be controlled by the workstation or processor or controller, in order to achieve and produce the varying levels of elasticity or support or rigidity or rigidness or flexibility of each one of the encapsulation regions 211-214. Optionally, a knitting-eye size modifier unit is used, to dynamically change the size of the knitting eye being used, and to thereby modify or set the desired level of flexibility or elasticity of each one of the encapsulation regions 211-214.

The discussion herein may relate, for demonstrative purposes, to a bra or to a shirt or to pants. However, the present invention may similarly comprise, or may similarly be used in conjunction with, other suitable garments and/or undergarments and/or clothing articles; for example, panties, boxers, briefs, underwear, shorts, sportswear, active-wear, yoga pants, aerobic pants, training pants, lingerie, thongs, shaper, body-shaper, shaping garment, shaping undergarment, shape-wear, active-wear, sports-wear, form-fitting undergarment, form-fitting garment, swimsuit, swim-wear, pants, trousers, socks, shirt, sweat-shirt, jacket, long-sleeve shirt, short-sleeve shirt, Polo shirt, T-shirt, skirt, dress, sports-skirt, tennis skirt, or the like.

Some embodiments of the present invention may be implemented by using a machine or an automated or semi-automatic production line, which may comprise, for example: cutting unit, welding unit, bonding unit, ultrasonic operations unit, gluing unit, conveyor belt, robotic arm, control unit, workstation; as well as suitable hardware components and/or software components, for example, processor to execute code, memory unit, storage unit, input unit (keyboard, mouse, touch-screen), output unit (screen, touch-screen), modems, transceivers or transmitters or receivers, wireless and/or wired communication links and/or transceivers or transmitters or receivers, power sources, Operating System (OS) and suitable applications, or the like.

In some embodiments, a clothing article comprises: a fabric intended to cover a region of a human body of a wearer; wherein said fabric comprises at least one fabric-made encapsulation zone which is surrounded by a fabric-made surrounding region; wherein the fabric-made encapsulation zone comprises at least a first fabric-made encapsulation region, which is surrounded by a second fabric-made encapsulation region, which is surrounded by a third fabric-made encapsulation region; wherein the first fabric-made encapsulation region has a first level of elasticity and a first level of rigidity, wherein the second fabric-made encapsulation region has a second level of elasticity that is smaller than the first level of elasticity of the first fabric-made encapsulation region, wherein the second fabric-made encapsulation region has a second level of rigidity that is greater than the first level of rigidity of the first fabric-made encapsulation region; wherein the third fabric-made encapsulation region has a third level of elasticity that is smaller than the second level of elasticity of the second fabric-made encapsulation region, wherein the third fabric-made encapsulation region has a third level of rigidity that is greater than the second level of rigidity of the second fabric-made encapsulation region.

In some embodiments, the term "fabric-made" may mean, for example, that an item is made of fabric and excludes or does not contain non-fabric materials such as wire, wires, supporting wire(s) or support wire(s), metal, hardened plastic, injected plastic, materials that cannot be knitted, or the like; but rather, consists of fabric materials such as, for example, cotton, polyester, wool, silk, materials that can be knitted, or the like.

In some embodiments, the fabric-made surrounding region has a fourth level of elasticity that is different from the first, the second, and the third levels of elasticity; wherein the fabric-made surrounding region has a fourth level of rigidity that is different from the first, the second, and the third levels of rigidity. In some embodiments, the fabric-made surrounding region has a fourth level of elasticity that is smaller from the first, the second, and the third levels of elasticity; wherein the fabric-made surrounding region has a fourth level of rigidity that is smaller from the first, the second, and the third levels of rigidity.

In some embodiments, the fabric-made surrounding region and the fabric-made encapsulation zone are seamless, and are made of a continued knitted yarn that continuously knits both the fabric-made surrounding region and the fabric-made encapsulation zone.

In some embodiments, the first fabric-made encapsulation region, the second fabric-made encapsulation region, and the third fabric-made encapsulation region are seamless, and are made of a continued knitted yarn that continuously knits the first fabric-made encapsulation region, the second fabric-made encapsulation region, and the third fabric-made encapsulation region.

In some embodiments, the first fabric-made encapsulation region, the second fabric-made encapsulation region, and the third fabric-made encapsulation region are concentric to each other. In some embodiments, the first fabric-made encapsulation region, the second fabric-made encapsulation region, and the third fabric-made encapsulation region are concentric to each other; wherein the first fabric-made encapsulation region is defined by a first hexagon surrounded by a second hexagon; wherein the second fabric-made encapsulation region is defined by the second hexagon surrounded by a third hexagon; wherein the third fabric-made encapsulation region is defined by the third hexagon surrounded by a fourth hexagon.

In some embodiments, the first fabric-made encapsulation region, the second fabric-made encapsulation region, and the third fabric-made encapsulation region are concentric to each other; wherein the first fabric-made encapsulation region is defined by a first circle surrounded by a second circle; wherein the second fabric-made encapsulation region is defined by the second circle surrounded by a third circle; wherein the third fabric-made encapsulation region is defined by the third circle surrounded by a fourth circle.

In some embodiments, the fabric-made encapsulation zone covers at least a portion of a human breast when worn by said wearer. In some embodiments, the fabric-made encapsulation zone covers at least a portion of a human buttock when worn by said wearer.

In some embodiments, the first fabric-made encapsulation region comprises yarn knitted in accordance with M1×N1 knitting pattern; wherein the second fabric-made encapsulation region comprises yarn knitted in accordance with M2×N2 knitting pattern which is different from said M1×N1 knitting pattern; wherein the third fabric-made encapsulation region comprises yarn knitted in accordance with M3×N3 knitting pattern which is different from said M1×N1 knitting pattern and is also different from said M2×N2 knitting pattern.

In some embodiments, the first fabric-made encapsulation region comprises a single yarn, wherein the third fabric-made encapsulation region comprises said single yarn and an additional yarn.

In some embodiments, the third fabric-made encapsulation region comprises a single yarn, wherein the first fabric-made encapsulation region comprises said single yarn and an additional yarn.

In some embodiments, the first fabric-made encapsulation region comprises a knitted yarn having knitting eye size of K1 millimeters; wherein the second fabric-made encapsulation region comprises said knitted yarn having knitting eye size of K2 millimeters; wherein the third fabric-made encapsulation region comprises said knitted yarn having knitting eye size of K3 millimeters; wherein K3 is greater than K2, and wherein K2 is greater than K1.

In some embodiments, the first fabric-made encapsulation region comprises a knitted yarn having knitting eye size of E1 millimeters; wherein the second fabric-made encapsulation region comprises said knitted yarn having knitting eye size of E2 millimeters; wherein the third fabric-made encapsulation region comprises said knitted yarn having knitting eye size of E3 millimeters; wherein E3 is smaller than E2, and wherein E2 is smaller than E1.

In some embodiments, the first fabric-made encapsulation region comprises a single knitted yarn at a first yarn-density of D1 threads per centimeter; wherein the second fabric-made encapsulation region comprises said single knitted yarn at a second yarn-density of D2 threads per centimeter; wherein the third fabric-made encapsulation region comprises said single knitted yarn at a third yarn-density of D3 threads per centimeter; wherein D3 is greater than D2, and wherein D2 is greater than D1.

In some embodiments, the first fabric-made encapsulation region comprises a first knitting pattern which provides to said first fabric-made encapsulation region said first level of rigidity; wherein the second fabric-made encapsulation region comprises a second, different, knitting pattern which provides to said second fabric-made encapsulation region said second level of rigidity; wherein the third fabric-made encapsulation region comprises a third, different, knitting pattern which provides to said third fabric-made encapsulation region said third level of rigidity.

In some embodiments, the first fabric-made encapsulation region, the second fabric-made encapsulation region, and the third fabric-made encapsulation region are concentric to each other; wherein at least one of the first fabric-made encapsulation region, the second fabric-made encapsulation region, and the third fabric-made encapsulation region, is defined by: a first type of closed shape, that is surrounded by an enlarged version of said first type of closed shape; wherein at least one other of the first fabric-made encapsulation region, the second fabric-made encapsulation region, and the third fabric-made encapsulation region, is defined by: a second type of closed shape, that is surrounded by an enlarged version of said second type of closed shape.

In some embodiments, the first fabric-made encapsulation region is formed of a first knitted yarn of a first yarn-type having a first knit-pattern; wherein the first fabric-made encapsulation region is formed of a second knitted yarn of a second yarn-type having a second knit-pattern; wherein the third fabric-made encapsulation region is formed of a third knitted yarn of a third yarn-type having a third knit-pattern; wherein the first yarn-type, the second yarn-type, and the third yarn-type are different from each other; wherein the first knit-pattern, the second knit-pattern, and the third knit-pattern are different from each other.

In some embodiments, a clothing article comprises: a fabric intended to cover a region of a human body of a wearer; wherein said fabric comprises at least one fabric-made encapsulation zone which is surrounded by a fabric-made surrounding region; wherein the fabric-made encapsulation zone comprises at least a first fabric-made encapsulation region, which is surrounded by a second fabric-made encapsulation region, which is surrounded by a third fabric-made encapsulation region; wherein the first fabric-made encapsulation region has a first level of elasticity and a first level of rigidity, wherein the second fabric-made encapsulation region has a second level of elasticity that is greater than the first level of elasticity of the first fabric-made encapsulation region, wherein the second fabric-made encapsulation region has a second level of rigidity that is smaller than the first level of rigidity of the first fabric-made encapsulation region; wherein the third fabric-made encapsulation region has a third level of elasticity that is greater than the second level of elasticity of the second fabric-made encapsulation region, wherein the third fabric-made encapsulation region has a third level of rigidity that is smaller than the second level of rigidity of the second fabric-made encapsulation region.

Functions, operations, components and/or features described herein with reference to one or more embodiments, may be combined with, or may be utilized in combination with, one or more other functions, operations, components and/or features described herein with reference to one or more other embodiments, or vice versa.

While certain features of some embodiments have been illustrated and described herein, many modifications, substitutions, changes, and equivalents may occur to those skilled in the art. Accordingly, the claims are intended to cover all such modifications, substitutions, changes, and equivalents.

What is claimed is:

1. A clothing article comprising:

a fabric intended to cover a region of a human body of a wearer;

wherein said fabric comprises at least one fabric-made encapsulation zone which is surrounded by a fabric-made surrounding region;

wherein the fabric-made encapsulation zone comprises at least a first fabric-made encapsulation region, which is surrounded by a second fabric-made encapsulation region, which is surrounded by a third fabric-made encapsulation region;

wherein the first fabric-made encapsulation region has a first level of elasticity and a first level of rigidity;

wherein the second fabric-made encapsulation region has a second level of elasticity that is smaller than the first level of elasticity of the first fabric-made encapsulation region, wherein the second fabric-made encapsulation region has a second level of rigidity that is greater than the first level of rigidity of the first fabric-made encapsulation region;

wherein the third fabric-made encapsulation region has a third level of elasticity that is smaller than the second level of elasticity of the second fabric-made encapsulation region, wherein the third fabric-made encapsulation region has a third level of rigidity that is greater than the second level of rigidity of the second fabric-made encapsulation region;

wherein the first fabric-made encapsulation region is a single-layer fabric region having a particular uniform thickness, and comprises a yarn knitted at a first knitting density;

wherein the second fabric-made encapsulation region is a single-layer fabric region having said particular uniform thickness, and comprises said yarn knitted at a second knitting density;

wherein the third fabric-made encapsulation region is a single-layer fabric region having said particular uniform thickness, and comprises said yarn knitted at a third knitting density;

wherein the first fabric-made encapsulation region is a single-layer fabric region that is entirely encapsulated and entirely surrounded, from all sides, by the second fabric-made encapsulation region;

wherein the second fabric-made encapsulation region is a single-layer fabric region that is entirely encapsulated and entirely surrounded, from all sides, by the third fabric-made encapsulation region.

2. The clothing article of claim 1, wherein the fabric-made surrounding region has a fourth level of elasticity that is different from the first, the second, and the third levels of elasticity; wherein the fabric-made surrounding region has a fourth level of rigidity that is different from the first, the second, and the third levels of rigidity.

3. The clothing article of claim 2, wherein the fabric-made surrounding region has a fourth level of elasticity that is smaller from the first, the second, and the third levels of elasticity; wherein the fabric-made surrounding region has a fourth level of rigidity that is smaller from the first, the second, and the third levels of rigidity.

4. The clothing article of claim 1, wherein the fabric-made surrounding region and the fabric-made encapsulation zone are seamless, and are made of a continued knitted yarn that continuously knits both the fabric-made surrounding region and the fabric-made encapsulation zone.

5. The clothing article of claim 1, wherein the first fabric-made encapsulation region, the second fabric-made encapsulation region, and the third fabric-made encapsulation region are seamless, and are made of a continued knitted yarn that continuously knits the first fabric-made encapsulation region, the second fabric-made encapsulation region, and the third fabric-made encapsulation region.

6. The clothing article of claim 1, wherein the first fabric-made encapsulation region, the second fabric-made encapsulation region, and the third fabric-made encapsulation region are concentric to each other.

7. The clothing article of claim 1, wherein the first fabric-made encapsulation region, the second fabric-made encapsulation region, and the third fabric-made encapsulation region are concentric to each other;

wherein the first fabric-made encapsulation region is defined by a first hexagon surrounded by a second hexagon;

wherein the second fabric-made encapsulation region is defined by the second hexagon surrounded by a third hexagon;

wherein the third fabric-made encapsulation region is defined by the third hexagon surrounded by a fourth hexagon.

8. The clothing article of claim 1, wherein the first fabric-made encapsulation region, the second fabric-made encapsulation region, and the third fabric-made encapsulation region are concentric to each other;

wherein the first fabric-made encapsulation region is defined by a first circle surrounded by a second circle;

wherein the second fabric-made encapsulation region is defined by the second circle surrounded by a third circle;

wherein the third fabric-made encapsulation region is defined by the third circle surrounded by a fourth circle.

9. The clothing article of claim 1, wherein the fabric-made encapsulation zone covers at least a portion of a human breast when worn by said wearer.

10. The clothing article of claim 1, wherein the fabric-made encapsulation zone covers at least a portion of a human buttock when worn by said wearer.

11. The clothing article of claim 1, wherein the first fabric-made encapsulation region comprises yarn knitted in accordance with M1×N1 knitting pattern;

wherein the second fabric-made encapsulation region comprises yarn knitted in accordance with M2×N2 knitting pattern which is different from said M1×N1 knitting pattern;

wherein the third fabric-made encapsulation region comprises yarn knitted in accordance with M3×N3 knitting pattern which is different from said M1×N1 knitting pattern and is also different from said M2×N2 knitting pattern;

wherein M1, N1, M2, N2, M3 and N3 are pre-defined values.

12. The clothing article of claim 1, wherein the first fabric-made encapsulation region comprises a single yarn, wherein the third fabric-made encapsulation region comprises said single yarn and an additional yarn.

13. The clothing article of claim 1, wherein the third fabric-made encapsulation region comprises a single yarn, wherein the first fabric-made encapsulation region comprises said single yarn and an additional yarn.

14. The clothing article of claim 1, wherein the first fabric-made encapsulation region comprises a knitted yarn having knitted loop size of K1 millimeters, wherein the second fabric-made encapsulation region comprises said knitted yarn having knitted loop size of K2 millimeters, wherein the third fabric-made encapsulation region comprises said knitted yarn having knitted loop size of K3 millimeters, wherein K3 is greater than K2, and wherein K2 is greater than K1.

15. The clothing article of claim 1, wherein the first fabric-made encapsulation region comprises a knitted yarn having knitted loop size of E1 millimeters, wherein the second fabric-made encapsulation region comprises said knitted yarn having knitted loop size of E2 millimeters, wherein the third fabric-made encapsulation region comprises said knitted yarn having knitted loop size of E3 millimeters, wherein E3 is smaller than E2, and wherein E2 is smaller than E1.

16. The clothing article of claim 1, wherein the first fabric-made encapsulation region comprises a single knitted yarn at a first yarn-density of D1 threads per centimeter, wherein the second fabric-made encapsulation region comprises said single knitted yarn at a second yarn-density of D2 threads per centimeter, wherein the third fabric-made encapsulation region comprises said single knitted yarn at a third yarn-density of D3 threads per centimeter, wherein D3 is greater than D2, and wherein D2 is greater than D1.

17. The clothing article of claim 1, wherein the first fabric-made encapsulation region comprises a first knitting pattern which provides to said first fabric-made encapsulation region said first level of rigidity;

wherein the second fabric-made encapsulation region comprises a second, different, knitting pattern which provides to said second fabric-made encapsulation region said second level of rigidity;

wherein the third fabric-made encapsulation region comprises a third, different, knitting pattern which provides to said third fabric-made encapsulation region said third level of rigidity.

18. The clothing article of claim 1, wherein the first fabric-made encapsulation region, the second fabric-made encapsulation region, and the third fabric-made encapsulation region are concentric to each other;

wherein at least one of the first fabric-made encapsulation region, the second fabric-made encapsulation region, and the third fabric-made encapsulation region, is defined by: a first type of closed shape, that is surrounded by an enlarged version of said first type of closed shape;

wherein at least one other of the first fabric-made encapsulation region, the second fabric-made encapsulation region, and the third fabric-made encapsulation region, is defined by: a second type of closed shape, that is surrounded by an enlarged version of said second type of closed shape.

19. The clothing article of claim 1, wherein the first fabric-made encapsulation region is formed of a first knitted yarn of a first yarn-type having a first knit-pattern;

wherein the first fabric-made encapsulation region is formed of a second knitted yarn of a second yarn-type having a second knit-pattern;

wherein the third fabric-made encapsulation region is formed of a third knitted yarn of a third yarn-type having a third knit-pattern;

wherein the first yarn-type, the second yarn-type, and the third yarn-type are different from each other;

wherein the first knit-pattern, the second knit-pattern, and the third knit-pattern are different from each other.

* * * * *